US007832450B2

(12) United States Patent
Brace et al.

(10) Patent No.: US 7,832,450 B2
(45) Date of Patent: Nov. 16, 2010

(54) LIFT CORD SYSTEM FOR RETRACTABLE COVERING

(75) Inventors: Clark Brace, Westminster, CO (US); Donald J. Clark, Thornton, CO (US); Brian M. Hoffmann, Louisville, CO (US); Ronald Holt, Westminster, CO (US)

(73) Assignee: Hunter Douglas Inc., Upper Saddle River, NJ (US)

( * ) Notice: Subject to any disclaimer, the term of this patent is extended or adjusted under 35 U.S.C. 154(b) by 191 days.

(21) Appl. No.: 12/176,803

(22) Filed: Jul. 21, 2008

(65) Prior Publication Data

US 2009/0025888 A1 Jan. 29, 2009

Related U.S. Application Data

(60) Provisional application No. 60/951,894, filed on Jul. 25, 2007.

(51) Int. Cl.
*E06B 9/32* (2006.01)

(52) U.S. Cl. ..... 160/84.05; 160/168.1 R; 160/173 R

(58) Field of Classification Search ..... 160/168.1 R, 160/173 R, 176.1 R, 177 R, 178.1 R, 84.04, 160/84.05
See application file for complete search history.

(56) References Cited

U.S. PATENT DOCUMENTS 3,280,890 A * 10/1966 Preziosi ..... 160/168.1 R
4,557,309 A * 12/1985 Judkins ..... 160/84.06
4,813,468 A * 3/1989 Fraser ..... 160/84.03
4,852,627 A 8/1989 Peterson et al.
5,002,112 A 3/1991 Schnebly et al.
5,170,108 A 12/1992 Peterson et al.
5,195,569 A 3/1993 Peterson et al.
6,053,236 A * 4/2000 Judkins et al. ..... 160/168.1 R
6,059,004 A * 5/2000 Oskam ..... 160/84.04
6,550,522 B1 4/2003 Lennon et al.
6,948,216 B2 * 9/2005 Gaudyn et al. ..... 16/205
7,311,132 B2 * 12/2007 Corey et al. ..... 160/168.1 R
7,383,871 B2 6/2008 Osinga
2009/0025888 A1 * 1/2009 Brace et al. ..... 160/84.05
2009/0139666 A1 * 6/2009 Anderson ..... 160/168.1 R

* cited by examiner

*Primary Examiner*—Blair M. Johnson
(74) *Attorney, Agent, or Firm*—Dorsey & Whitney LLP

(57) ABSTRACT

A lift cord system for operating a retractable covering for architectural openings includes at least one cord loop which extends from a tassel through a fabric for the covering where it is slidably connected to the bottom rail for adjustment of the desired maximum spacing of the top rail and bottom rail and the orientation of the bottom rail relative to the top rail so the rails can be easily maintained in a parallel relationship. The cord loop is also anchored to the bottom rail at a separate location in a manner so as to fix the maximum separation between the top and bottom rails so the covering desirably fits the size of the architectural opening in which it is mounted. Alternative embodiments include top down/bottom up coverings and coverings including a middle rail in addition to top and bottom rails.

10 Claims, 37 Drawing Sheets

LIFT CORD SYSTEM FOR RETRACTABLE COVERING

CROSS-REFERENCES TO RELATED APPLICATIONS

The present application claims benefit under 35 U.S.C. §119(e) to U.S. Provisional Patent Application No. 60/951,894, which was filed on Jul. 25, 2007 and entitled "Lift Cord System For Retractable Covering", which is incorporated by reference into the present application in its entirety.

BACKGROUND OF THE INVENTION

1. Field of the Invention

The present invention relates generally to retractable coverings for architectural openings and more particularly to a lift cord system for a retractable covering wherein the lift cord includes an endless loop of cord operably connected to the bottom rail of the covering to enable easy leveling of the bottom rail.

2. Description of the Relevant Art

Coverings for architectural openings have been used for numerous years to cover windows, doorways, archways, and the like, with such coverings assuming numerous forms and configurations. Examples of such include draperies, venetian blinds, vertical blinds, retractable shades, and the like. More recently, retractable coverings have been made with a cellular fabric for not only enhanced aesthetics but to also improve insulation across the architectural opening.

Retractable cellular coverings as well as other forms of retractable coverings typically include a top rail or headrail in which operative components of the covering are enclosed, a bottom rail and a flexible fabric or shade material extending between the top rail and bottom rail. A lift cord system is typically employed for raising and lowering the bottom rail to retract and extend the covering, respectively, with the lift cord system typically including several independent cords which are gathered in an hand-operated tassel at one end of the covering, extend through a cord lock in the top rail, across a portion of the top rail, and down through the fabric or shade material for connection to the bottom rail. In this manner, by pulling downwardly on the tassel, the bottom rail is raised and vice versa by allowing the tassel to elevate, the bottom rail can be lowered. The cord lock releasably holds the lift cords in a desired position so the covering can be fully elevated, partially elevated, or fully extended as desired.

As will be appreciated, for desired aesthetics, it is desired that the bottom rail remain parallel to the top rail during all operations of the covering and when a plurality of lift cords are utilized, it is sometimes difficult to make each lift cord of a length that allows the bottom rail to be suspended from the top rail in a parallel relationship therewith. Accordingly, systems have been devised for adjusting the effective lengths of the lift cords so the bottom rail can remain parallel with the top rail regardless of its separation therefrom. An example of a system for adjusting the effective lengths of lift cords is shown, for example, in U.S. patent application Ser. No. 10/171,358 filed Jun. 11, 2002, which issued on Jun. 10, 2008 as U.S. Pat. No. 7,383,871 and entitled Equalizing Connector for Window Covering Pull Cords, which is of common ownership with the present application.

The present invention has been made to further simplify a cord lift system for a retractable covering so the bottom rail can be conveniently leveled relative to the top rail.

SUMMARY OF THE INVENTION

While the lift cord system of the present invention could be utilized with many different embodiments of retractable coverings, it is disclosed in a retractable covering that includes a top rail, a bottom rail, and a collapsible, flexible cellular fabric extending between the top and bottom rails.

The lift cord system in accordance with the invention includes an elongated lift cord having its ends secured together in a tassel for hand manipulation by an operator so an endless loop of cord is defined. Of course, as would be well known to those skilled in the art, the hand-operated system illustrated could be easily modified to a motor-driven system, which would not affect the primary features of the present invention. The endless loop of cord extends upwardly from the tassel where it passes through a conventional cord lock with first and second runs of the cord loop extending within the top rail with one run of the cord loop extending vertically downwardly from the top rail at one location through the flexible fabric and the second run extending downwardly from the top rail through the flexible fabric at a second location. The first and second runs of the cord loop are operatively connected to associated cord brackets fixed within the bottom rail in alignment with the first and second runs and include friction fingers which permit but inhibit sliding movement of the cord runs relative to associated cord brackets. Each cord run extends beyond its associated cord bracket so that an end of the cord loop within the bottom rail can be slidably anchored to the bottom rail.

In this manner, when the tassel is pulled downwardly, the cord loop which passes through the bottom rail, where it is connected to the cord brackets and operatively to the bottom rail itself, is elevated to retract the covering across the architectural opening. By allowing the tassel to rise, the bottom rail is permitted to drop so the covering is extended across the architectural opening. If the bottom rail is not parallel with the top rail, it can simply be forcibly tilted to overcome the sliding resistance of the friction fingers to the cord so the relative position of the cord runs are changed relative to their associated cord brackets which changes the angular orientation of the bottom rail. As mentioned, the friction fingers only resist sliding movement of the cord runs through the cord brackets, they do not prohibit movement so the bottom rail will retain a selected orientation unless it is desired to change that orientation.

The end of the cord loop is slidably anchored to the bottom rail with an anchor cord having one end operably and slidably connected to the cord loop. The opposite end of the anchor cord is adjustably secured to the bottom rail in a manner such that the spacing of the operable connection of the anchor cord to the cord loop from the bottom rail can be adjusted allowing the elevation of the bottom rail to be easily selected and fixed.

The anchor cord is secured to the bottom rail by extending the anchor cord through one or more passages in the bottom rail and securing the cord in a knotted fashion. The bottom rail includes a removable cover that snaps over the passages and anchor cord to conceal the passages and anchor cord from view exteriorly of the bottom rail for desired aesthetics.

Other aspects, features, and details of the present invention can be more completely understood by reference to the following detailed description of a preferred embodiment, taken in conjunction with the drawings and from the appended claims.

DESCRIPTION OF THE PREFERRED EMBODIMENT

Figure 1:
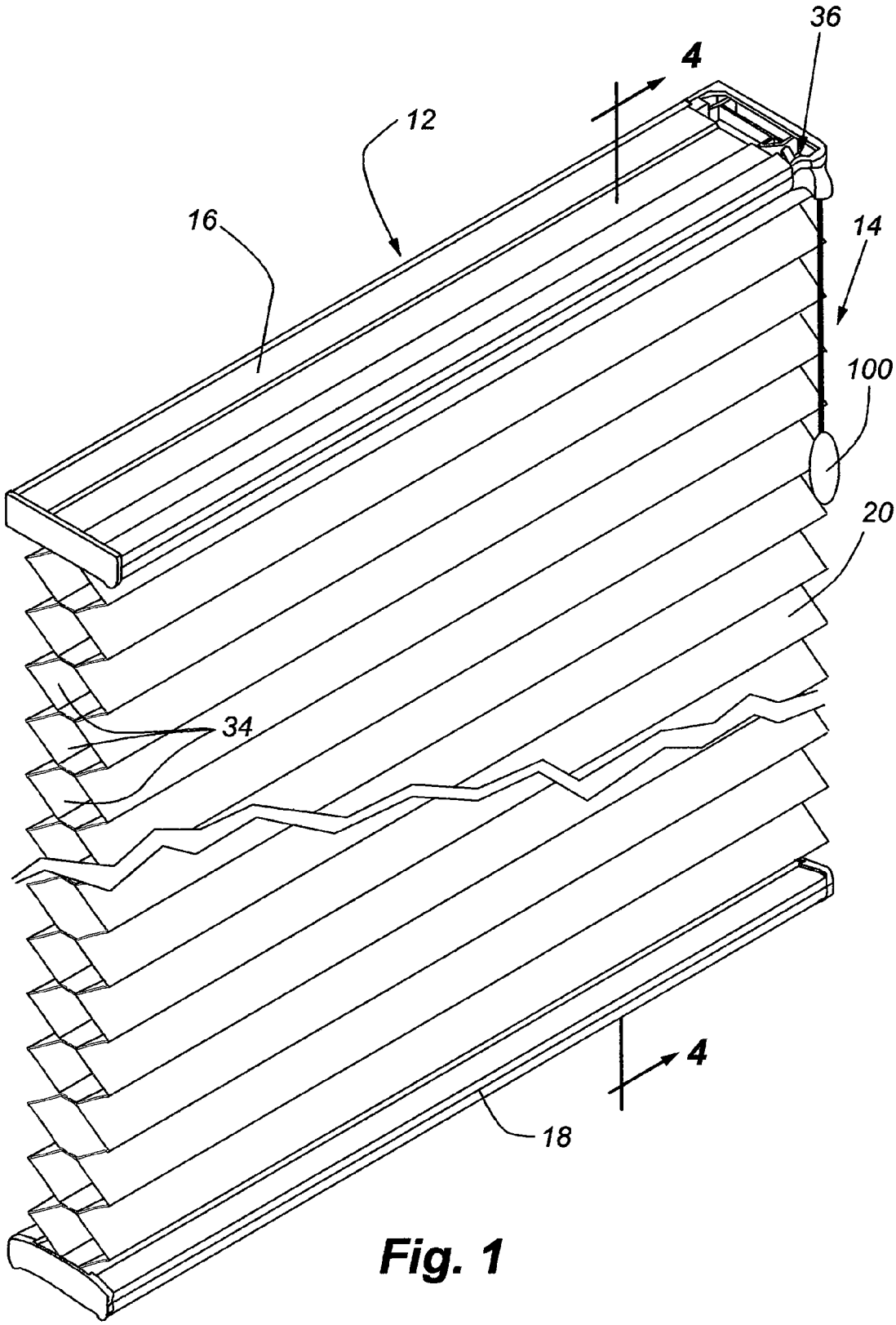
FIG. 1 is an isometric of a retractable covering incorporating the lift cord system of the present invention with the covering shown in an extended position.

Referring to FIG. 1, a retractable covering 12 incorporating the cord lift system 14 of the present invention is illustrated as including a top rail or headrail 16, a bottom rail 18, a flexible cellular fabric material 20 extending between the top and bottom rails, and the lift cord system of the invention. The covering is shown in an extended position in FIG. 1 and in a retracted position in FIG. 2. While the lift cord system of the invention is described in connection with a retractable cellular covering as illustrated, it will be understood by those skilled in the art the system would be useful with most any retractable covering having top and bottom rails with a shade or covering material extending therebetween and with the covering being operable by moving the top or bottom rail relative to the other.

Figure 3:
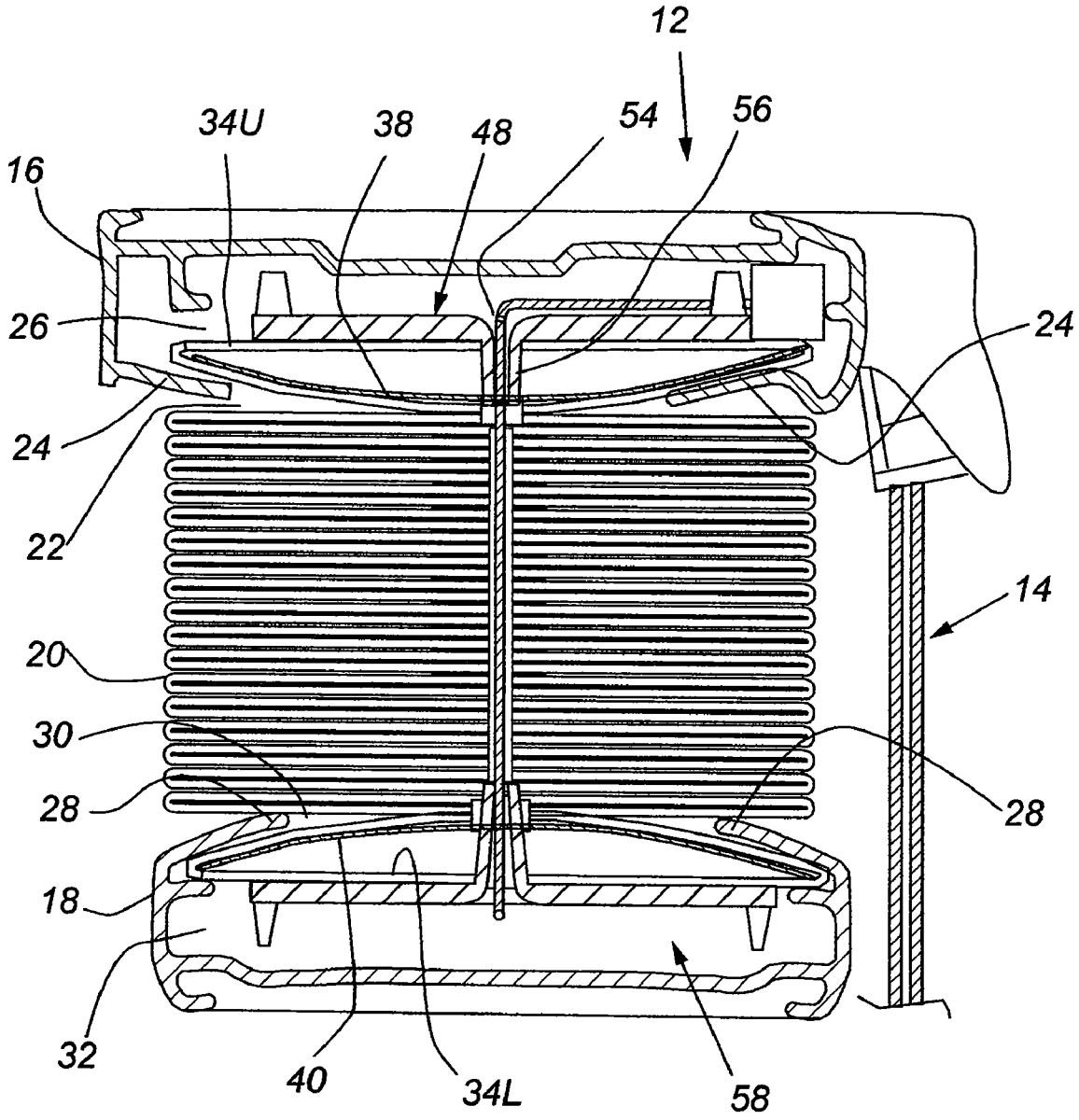
FIG. 3 is an enlarged section taken along line 3-3 of FIG. 2.
Figure 4:
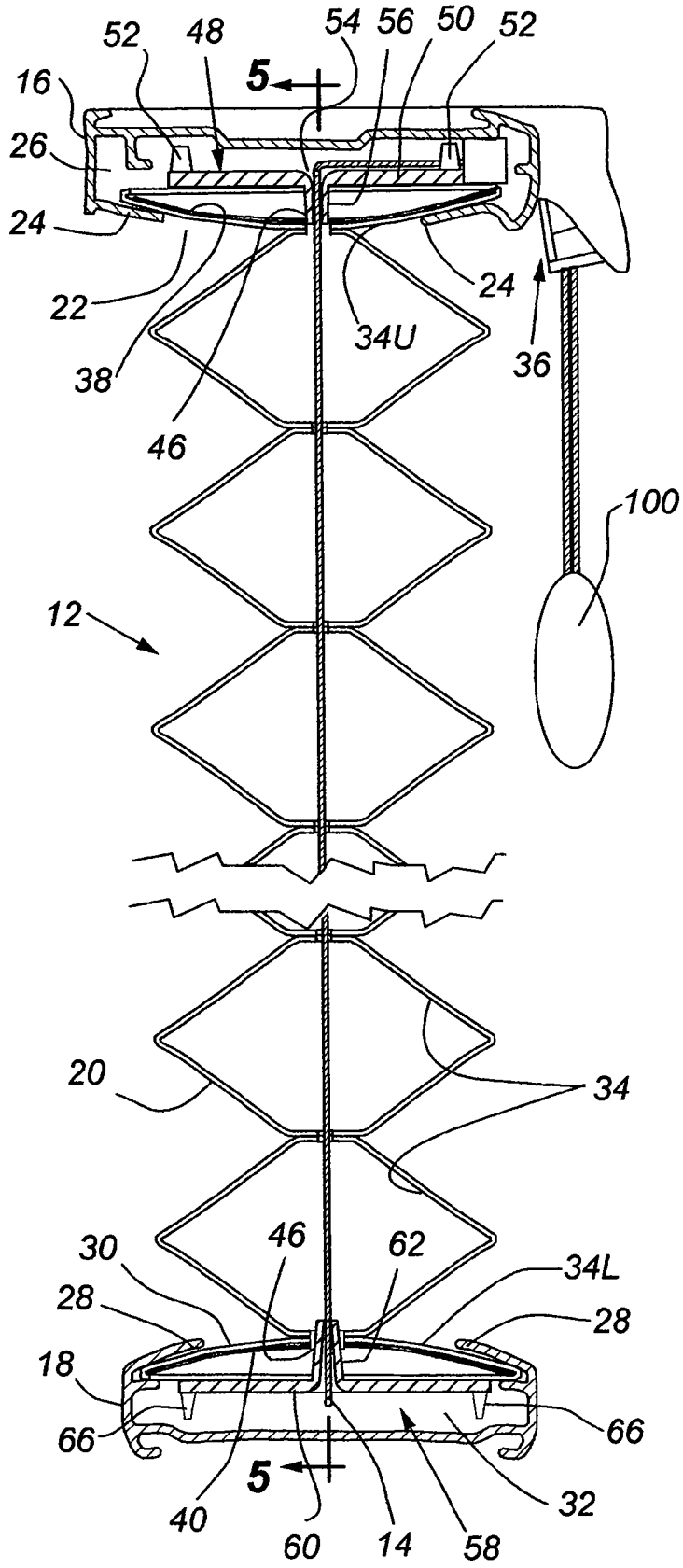
FIG. 4 is an enlarged section taken along line 4-4 of FIG. 1.

With reference to FIGS. 3 and 4, the top rail 16 of the covering, which could in reality assume numerous different forms, is illustrated as being an extruded channel-shaped member with an elongated channel opening downwardly and defining a gap or opening 22 between inturned longitudinal lips 24 which extend the length of the elongated headrail. A downwardly opening cavity 26 is thereby formed within the headrail for securing the top of the cellular fabric material 20 and for receiving portions of the lift cord system 14 as will be described in more detail hereafter.

As also seen in FIGS. 3 and 4, the bottom rail 18 is similarly illustrated as an elongated extruded member having inturned longitudinal lips 28 extending along the length thereof at the top so as to define an elongated opening 30 through the top. An upwardly opening cavity 32 is thereby defined within the bottom rail in which a portion of the fabric material 20 and the lift cord system can be anchored.

The fabric material 20 itself can be seen to comprise a plurality of horizontally extending cells 34 of hexagonal transverse cross-section which are secured to adjacent cells along top and bottom surfaces thereof. The material from which the cellular fabric is made retains a crease so the fabric material has a uniform appearance but the cells are transversely collapsible between the expanded position of FIG. 4 and the retracted position of FIG. 3 so the fabric when the covering is retracted usurps only a small vertical space. Examples of fabric materials suitable for use in a covering of the type disclosed herein are well known in the art.

Figure 2:
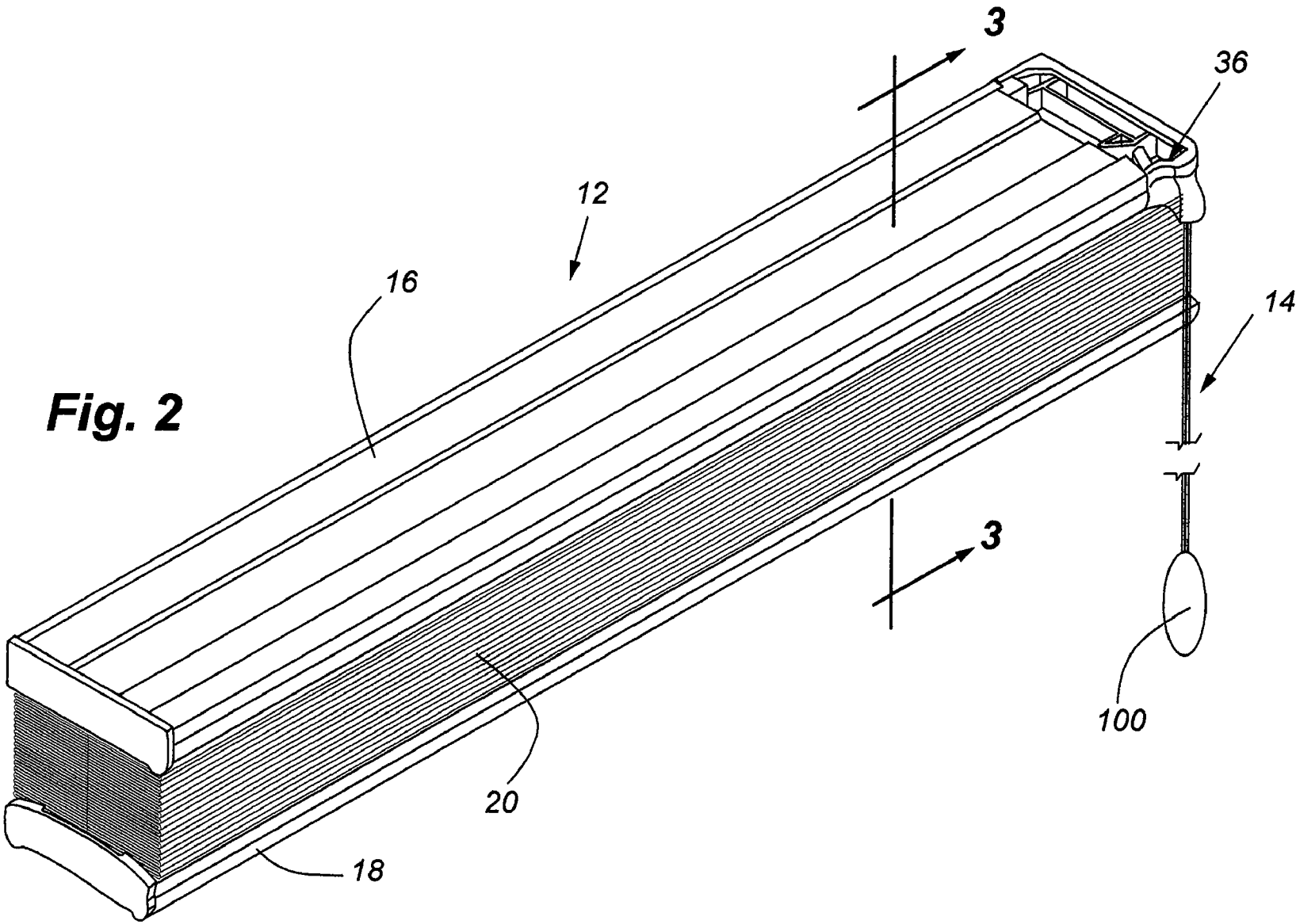
FIG. 2 is an isometric of the covering of FIG. 1 showing the covering in a retracted position.
Figure 5:
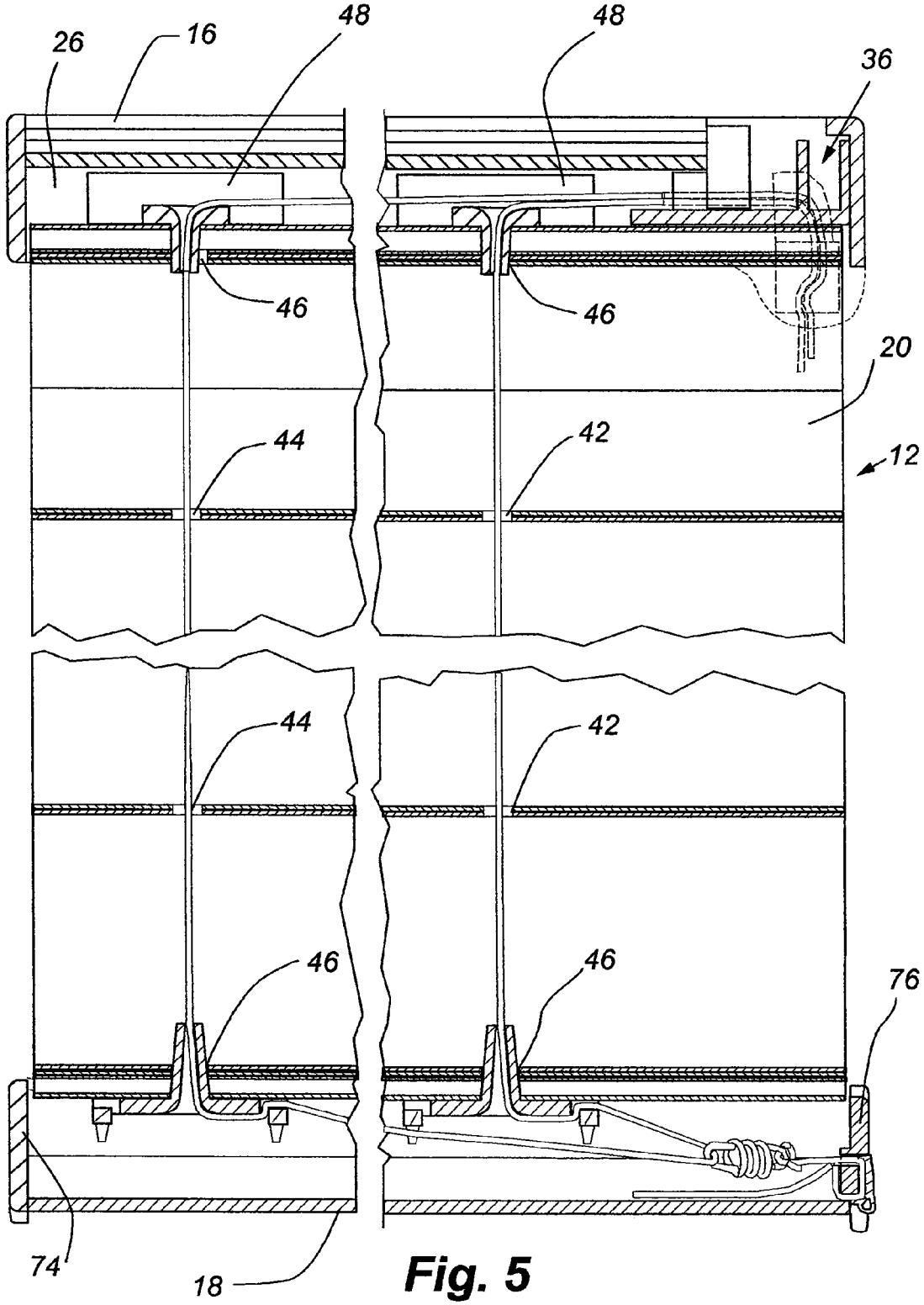
FIG. 5 is a section taken along line 5-5 of FIG. 4.

At one end of the top rail 16, as illustrated in FIGS. 1, 2, and 5, a conventional cord lock 36 is incorporated into the headrail that cooperates with the lift cord system 14 in selectively securing the system in any desired position. Such cord locks are commonly used in the industry and a description thereof is not deemed necessary as it would be well known to those skilled in the art. Suffice it to say the cord lock is designed so that one or more cords passing therethrough can be selectively secured or locked in position so they do not move relative to the headrail but by manipulating the cord lock through movement of the cords in a predetermined direction, the cord lock releases the cords so the cords can slide in either direction through the cord lock allowing the covering to extend or retract.

As probably best appreciated by reference to FIGS. 3, 4, and 7, the fabric material 20 is secured to the top rail 16 by inserting the uppermost cell 34U of the fabric through the opening 23 in the bottom of the top rail and into the downwardly opening cavity 26 of the top rail and subsequently sliding into the upper cell a rigid or semi-rigid anchor strip 38 of arcuate transverse cross-section, which is wider than the spacing between the lips 24 of the top rail. In this manner, the anchor strip is confined within the cavity of the top rail along with the upper cell of the fabric. The fabric is thereby uniformly suspended from the top rail.

The lowermost cell 34L in the fabric 20 is similarly connected to the bottom rail 18 by a second anchor strip 40 which is inserted into the lowermost cell after that cell has been positioned within the upwardly opening cavity 32 of the bottom rail so the anchor strip is confined beneath the lips 28 of the bottom rail thereby securing the lowermost cell of the fabric to the bottom rail. It will also be appreciated by reference to FIG. 7 that the cellular fabric has two sets of vertically aligned holes 42 and 44 which extend through each cell and complementary holes 46 through the upper and lower anchor strips with these holes being alignable to receive a portion of the lift cord system as will be described hereafter.

Also within the top rail 16 are a pair of slide brackets 48 which are confined within the downwardly opening cavity 26 of the top rail as possibly best seen in FIG. 4. The slide brackets have a transverse main body 50 with enlarged rails 52 perpendicular to the main body at opposite ends to support the slide brackets within the top rail. Further, a passage 54 and a downwardly extending hollow neck 56 communicating therewith form part of the main body and define a passageway through which portions of the lift cord system of the invention can pass as will be explained hereafter. It should also be noted the slide brackets might be formed so that in one orientation as shown in FIG. 7 where the main body extends transversely of the top rail, they will accommodate a top rail suitable for a fabric of a predetermined depth but they can be rotated 90° to present a slimmer profile if used in a top rail for a covering having a fabric of a shallower depth which is not illustrated. In other words, the slide brackets are modular so as to be useful in coverings having fabrics of different depths. As probably best appreciated by reference to FIG. 7, each slide bracket is positioned within the top rail in alignment with the vertically aligned holes 42 or 44 in the fabric and the holes 46 in the anchor strips.

Similar to the slide brackets 48 in the top rail 16, a pair of cord brackets 58 are incorporated into the bottom rail 18 with each cord bracket being associated and vertically aligned with a slide bracket in the top rail. Each cord bracket has a generally rectangular plate-like main body 60 with an upstanding hollow neck 62 defining a passage 64 through the main body for slidable receipt of a component of the lift cord system as will be described hereafter. Further, the cord bracket has legs 66 at each corner to desirably position the cord bracket within the bottom rail as possibly best seen in FIG. 4. Each of the four side edges of the main body has a notch 68 (FIGS. 7 and 8) formed therein with a serrated friction finger 70 across which a lift cord component can pass to restrict sliding movement of the lift cord component relative to the cord bracket. As with the slide brackets in the top rail, the rectangular configuration of the cord brackets in the bottom rail are designed to render the brackets modular so they can be used in one orientation as shown in FIG. 7 for a relatively wide fabric in the covering or can be rotated 90 degrees to accommodate a narrow bottom rail for use with a shallower fabric for the covering.

Figure 6A:
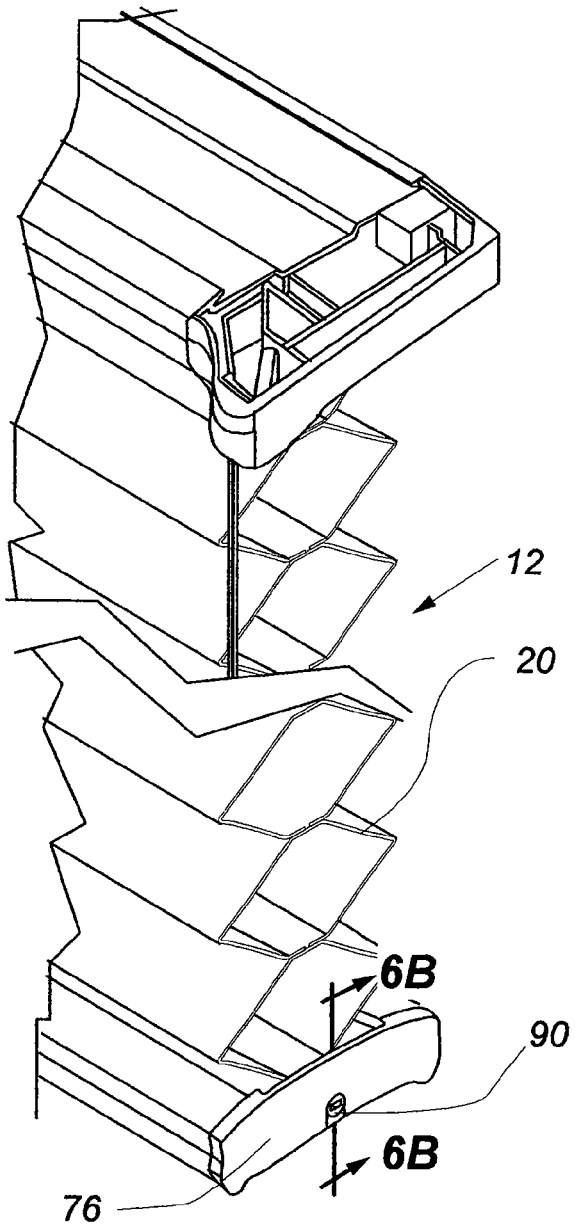
FIG. 6A is a fragmentary isometric looking downwardly on the covering of FIG. 1 at the end of the covering having the cord lock.
Figure 6B:
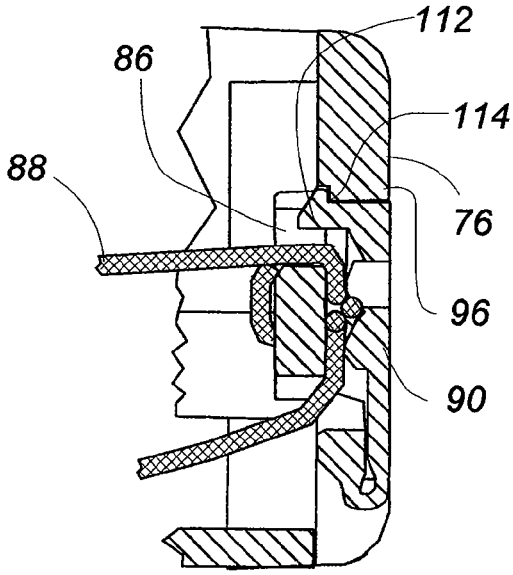
FIG. 6B is an enlarged fragmentary section taken along line 6B-6B of FIG. 6A.
Figure 6C:
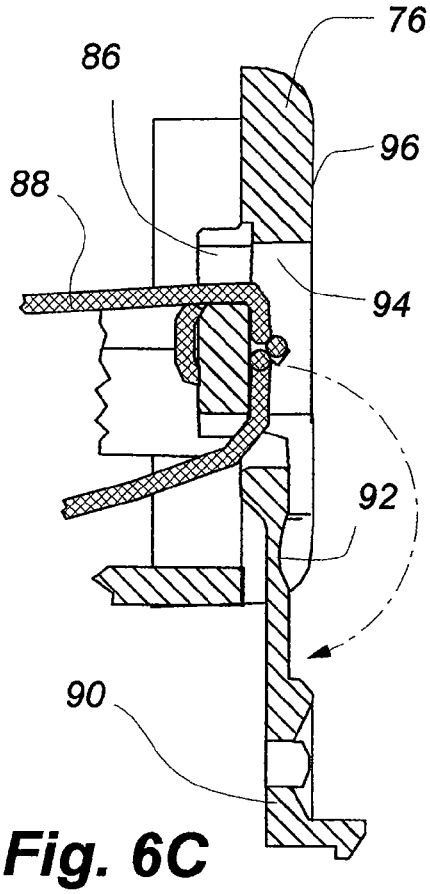
FIG. 6C is a section similar to FIG. 6B showing the removable cover in the bottom rail end cap in an open position.
Figure 6D:
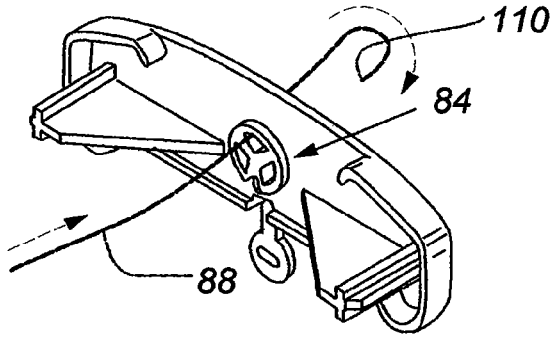
FIG. 6D is an isometric looking at the rear of an end cap showing the first step of attaching the anchor cord to the end cap.
Figure 6E:
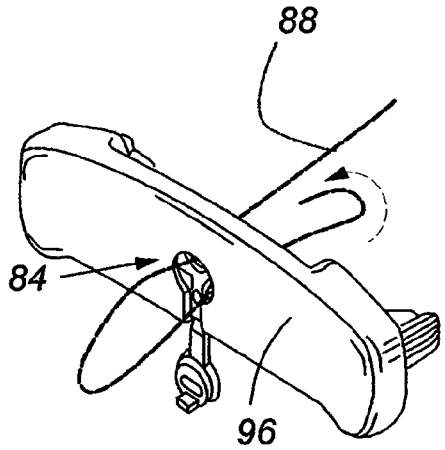
FIG. 6E is an isometric looking at the outer surface of the end cap of FIG. 6D showing a second step in attaching the anchor cord to the end cap.
Figure 6F:
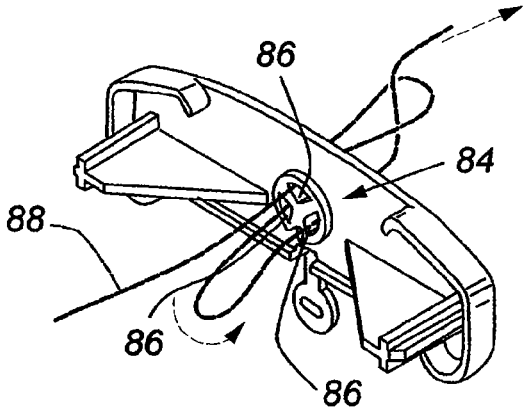
FIG. 6F is an isometric similar to FIG. 6D showing a third step in attaching the anchor cord to the end cap.
Figure 6G:
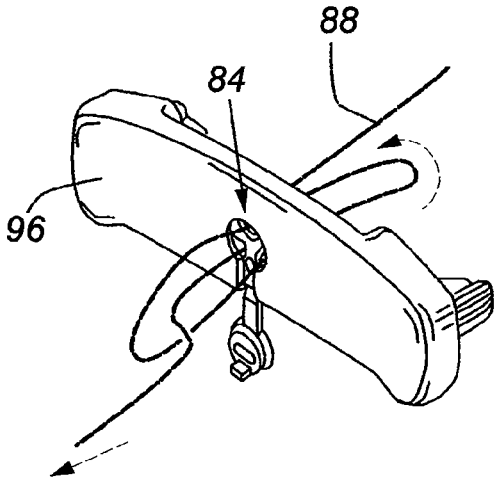
FIG. 6G is an isometric looking at the outer surface of the end cap illustrating the same step shown in FIG. 6F.
Figure 7:
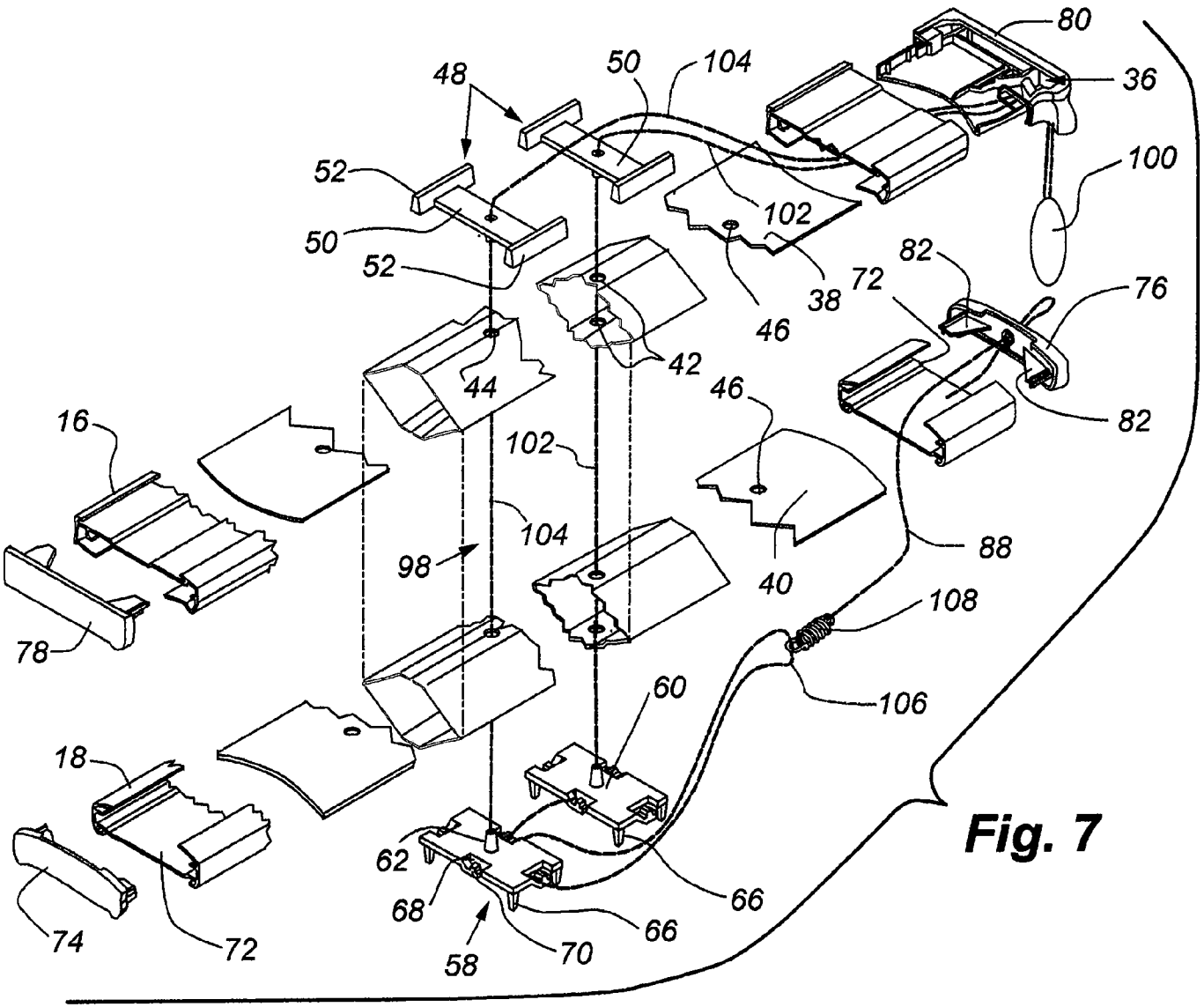
FIG. 7 is a diagrammatic isometric with parts removed illustrating the routing of the lift cord system relative to the other components of the covering.

Before further describing the components of the lift cord system 14, reference is made to FIGS. 5, 6A-6G and 7 where it can be seen that the open ends 72 of the extruded bottom rail 18 receive end caps 74 and 76 similarly configured in transverse cross-section to the bottom rail itself so as to provide a closure for each end of the bottom rail. Similarly, the top rail 16 has end caps 78 and 80 forming a similar function with one of those end caps 80 also housing the cord lock system 36 as possibly best seen in FIG. 7. The end cap 76 in the right end of the bottom rail, however, as seen in FIG. 7, has been uniquely designed so that not only is it frictionally retainable within the associated open end 72 of the bottom rail with a pair of gusset fingers 82, but a transverse hole 84 is provided through the longitudinal center of the end cap with the hole being divided as best seen, for example, in FIG. 6D into three separate passages 86. The three separate passages are utilized for securing one end of an anchor cord 88 of the lift cord system as will be described hereafter. A removable closure cover 90 is integrally, flexibly, and hingedly secured to the main body of the end cap with a living hinge 92. The cover is configured and sized to fit within a recess 94 defined in an outer surface 96 of the end cap so the cover can not only cover the passages through the end cap but also the components of the lift cord system incorporated therewith as will be described in more detail hereafter.

Figure 8:
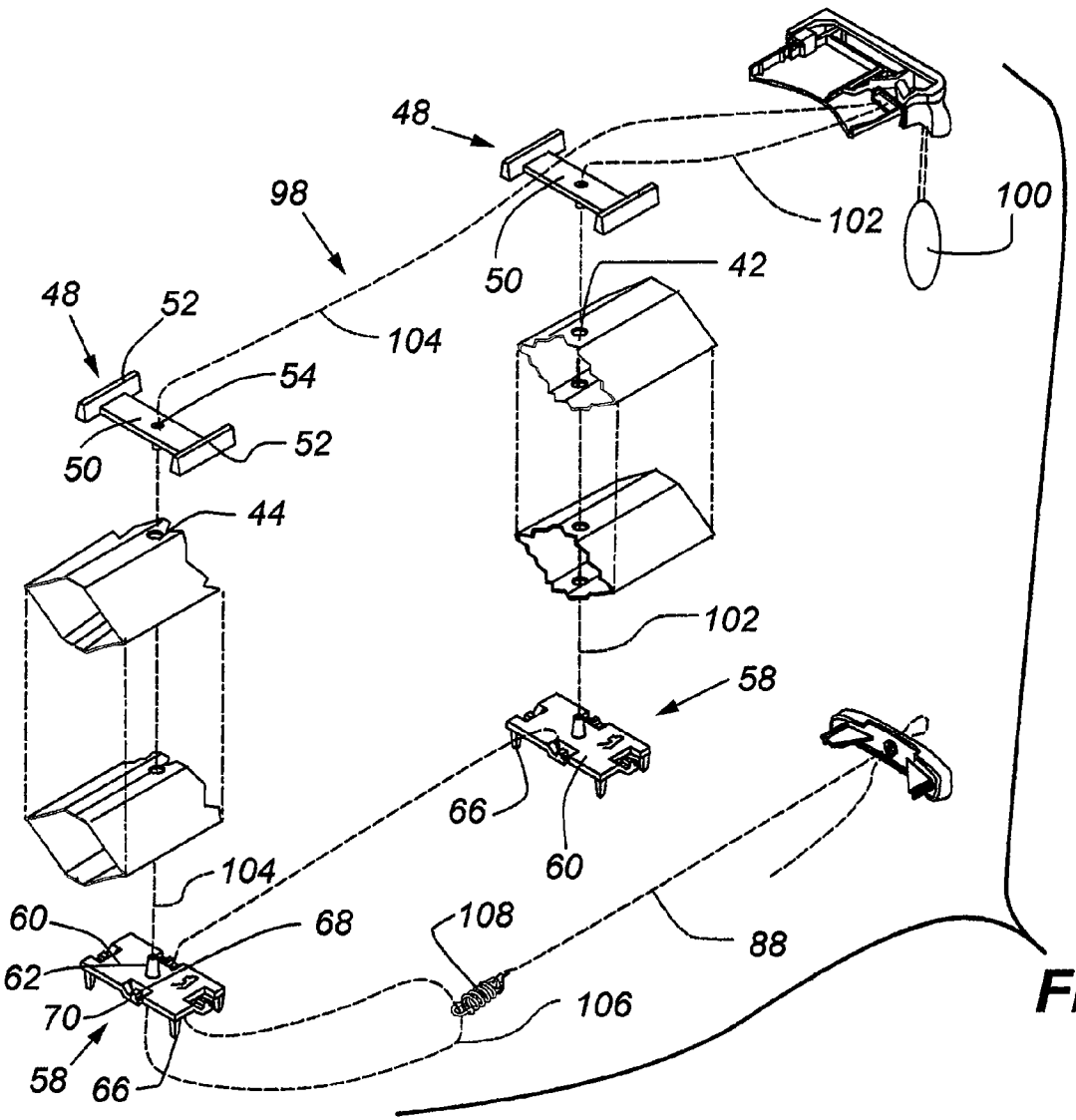
FIG. 8 is a diagrammatic isometric similar to FIG. 7 with some components of the covering removed for clarity.

The lift cord system 14 itself (FIGS. 7 and 8) includes an elongated main lift cord 98 made of any suitable, flexible, but non-extensible material having its ends secured together in any conventional manner. In the illustrated embodiment the ends are interconnected and confined within a conventional tassel 100 commonly used for operating retractable coverings. The main lift cord component thereby becomes a loop so as to define first 102 and second 104 cord runs as well as an end 106 of the loop within the bottom rail. With reference to FIGS. 7 and 8, it will be seen that the cord runs emanating from the tassel extend upwardly through the cord lock 36 and then transversely of the covering through the top rail 16 with one of those runs 102 then extending downwardly through the passage 54 in the first encountered slide bracket 48 and the second of those runs 104 subsequently extending downwardly through the passage 54 in the second encountered slide bracket with the slide brackets of course being separated a predetermined distance commensurate with the spacing of the vertically aligned holes 42 and 44 through the flexible fabric material 20. The first cord run 102 slidably passes through the neck 56 in the first slide bracket and slidably through the holes 42, through the cells of the fabric material and then slidably through the neck 62 of the cord bracket 58*a* in the bottom rail 18 associated therewith and from there it extends upwardly across a friction finger 70 in the cord bracket 58*a* closest to the opposite cord bracket 58*b*. The first run 102 then extends downwardly from the cord bracket 58*a*, across a confronting friction finger 70 of the other cord bracket 58*b* and out of the bottom of the other cord bracket before extending to the looped end 106 of the main cord. The second cord run 104 after extending along the top rail 16 is slidably passed through the second encountered slide bracket 48 and slidably through the aligned holes 44 in the fabric material before being slidably passed through the upstanding neck 56 in the main body of the other cord bracket 58*b* which is associated therewith and after passing through the other cord bracket, the second run of the main cord extends to the looped end 106 of the main cord which is within the bottom rail.

The looped end 106 of the main cord 98 is slidably connected to one end of a coil spring 108 within the bottom rail whose opposite end is anchored to the anchor cord 88 which is securable to the end cap 76 at the right end of the bottom rail. The anchor cord is secured to the end cap in a manner to be described hereafter but it should be noted the spacing between the coil spring and the end cap 76, once the anchor cord is secured to the end cap, can be adjusted to accommodate a desired spacing between the headrail and the bottom rail inasmuch as the cord runs 102 and 104 are slidably fixed to their associated cord brackets with the friction fingers 70 to define the length of the loop of cord above the bottom rail and consequently the length of the loop of cord below the bottom rail. The friction fingers as will be appreciated will hold the position of a cord run relative to a cord bracket associated with the friction finger under normal operating conditions of the covering but a predetermined and relatively strong force applied to either the cord bracket or a run of the lift cord will allow the friction finger to permit sliding movement of a cord thereby.

It will be appreciated by adjusting the position of a cord bracket 58 relative to a cord run 102 or 104 extending therethrough, the angular orientation of the bottom rail 18 can be adjusted so it is parallel with the top rail 16. Further, the maximum desired spacing between the top rail and the bottom rail for fitting the covering in an architectural opening can be regulated by adjusting the size of the cord loop above the bottom rail and adjusting the length of the anchor cord 88 beneath the bottom rail. The positioning of cord runs relative to the cord brackets affects the size of the cord loop above the bottom rail and therefore plays a role in leveling the bottom rail and determining its desired maximum spacing from the top rail. In other words, if it were desired to lower the lowermost position of the bottom rail to increase the maximum spacing between the top rail and the bottom rail, the loop of cord 98 above the bottom rail could be enlarged. This is accomplished by sliding the runs of the cord loop relative to the friction fingers in a direction to allow the bottom rail to drop by enlarging the size of the cord loop above the bottom rail. The length of the anchor cord can then be shortened to draw taut the end 106 of the cord loop beneath the bottom rail. Of course, the reverse of this procedure is followed to raise the lowermost position of the bottom rail.

As mentioned previously, the positioning of the coil spring 108, which allows the loop of cord beneath the bottom rail to be drawn taut, is adjustable with the anchor cord 88 and the anchor cord is conveniently secured to the end cap 76 at any desired position along the length of the anchor cord. With reference to FIGS. 6D-6G, a procedure is illustrated for securing the anchor cord to the end cap 76 at a desired location along the length of the anchor cord. Looking first at FIG. 6D, the free end 110 of the anchor cord is extended from internally of the bottom rail 18 through a passage 86 in the end cap so the free end is beyond the outer surface 96 of the end cap. The free end of the anchor cord is then reversed or looped and extended back through a second passage 86 as illustrated in FIG. 6E so the free end is then on the inside of the end cap. Subsequently, as illustrated in FIG. 6F, the free end of the anchor cord is extended through the third passage 86 from the inside of the end cap and once the free end protrudes past the outer surface of the end cap, it is passed through the loop previously formed in the anchor cord on the outside of the end cap. The free end of the cord can then be pulled taut to cinch or lock the cord in a knotted fashion to the end cap at a predetermined location along the length of the anchor cord. As will be appreciated, the free end of the anchor cord is then on the outside of the end cap and to conceal it from view, it can be extended back through one of the passages 86 in the end cap and then the closure cover 90 can be pivoted into engagement with the recess 94 having the passages and snapped or frictionally retained in place to cover the passages and the anchor cord extending therethrough. This arrangement is illustrated in FIGS. 6B and 6C with FIG. 6C showing the cover 90 in a downwardly pivoted or open position and in FIG. 6B the cover pivoted upwardly into a closed position and locked in place with a snap fit inasmuch as the cover has a catch finger 112 along one edge which is adapted to snap onto a shoulder 114 in the main body of the end cap.

Figure 6H:
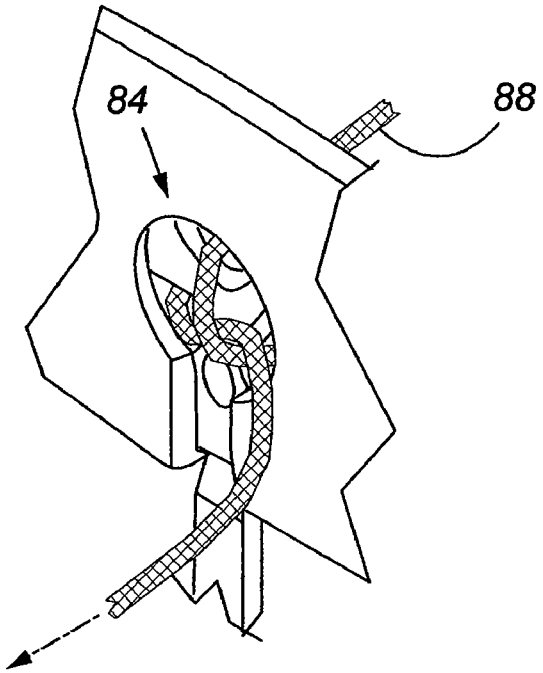
FIG. 6H is a fragmentary section looking at the outer surface of the end cap after the anchor cord has been connected thereto but illustrating with an arrow the direction on which the anchor cord could be pulled to raise the elevation of the bottom rail.
Figure 6J:
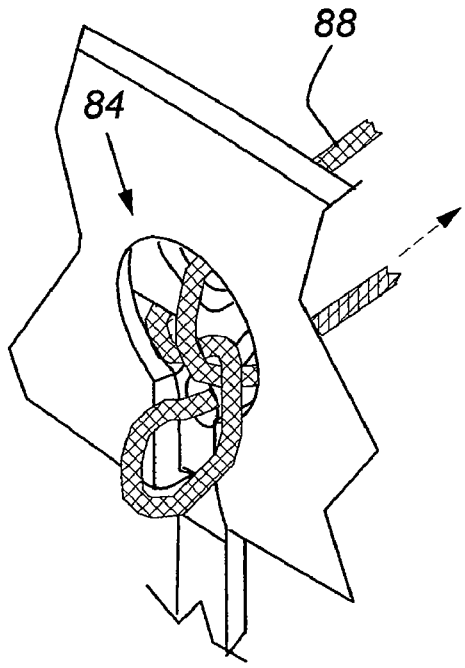
FIG. 6J is a section similar to FIG. 6H illustrating the placement of the end of the anchor cord after the elevation of the bottom rail had been fixed and to position the anchor cord relative to the end cap for closure of the removable cover.
Figure 6K:
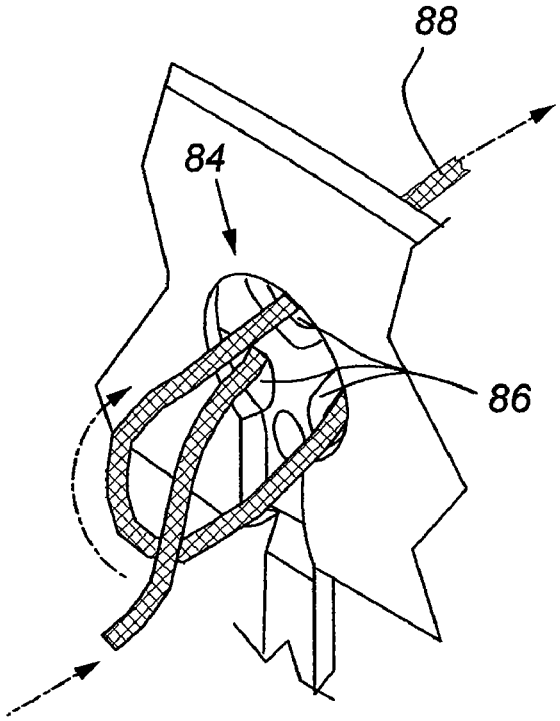
FIG. 6K is a fragmentary isometric similar to FIGS. 6H and 6J illustrating with arrows the direction for movement of the anchor cord relative to the end cap to lower the fixed position of the bottom rail.

With reference to FIGS. 6H-6K, illustrations are made to show how the relative relationship of the anchor cord 88 to the end cap 76 are made to adjust the separation of the coil spring 108 from the other cord bracket 58*b*. In order to change the relationship of the anchor cord to the end cap, as illustrated in FIG. 6H, the free end 110 of the anchor cord is pulled outwardly so it protrudes from the outer surface 96 of the end cap and the knot is then somewhat loosened so the effective length of the anchor cord can be shortened and the separation of the coil spring from the end cap reduced by pulling the anchor cord. Once the desired spacing has been achieved, the free end of the anchor cord is again inserted back through a passage 86 in the end cap and pulled to cinch the cord and lock it to the end cap at the newly selected position. Similarly, as shown in FIG. 6K, if it is desired to further separate the coil spring from the end cap or lengthen the effective length of the anchor cord, the knot is loosened by extending the free end of the anchor cord back through the end cap so it is on the outside of the end cap and then loosening the knot to allow the effective length of the anchor cord to be lengthened from the end cap to the coil spring before again cinching the anchor cord to the end cap as described previously.

The coil spring 108 itself is a very strong spring and does not under normal operation of the covering extend at all but merely provides a sliding relationship between the anchor cord 88 and the main cord 98. However, should the covering be put under unusual stress such as might occur when the covering is being retracted but the bottom rail is caught, the spring will give a little to prevent damage to the system.

It will be appreciated from the above that a lift system 14 for a covering for an architectural opening has been described which permits the system to be operated in a conventional manner in that the lowering of the tassel 100 will raise the bottom rail 18 and raising of the tassel will lower the bottom rail but the system in addition provides an easy adjustment for leveling the bottom rail relative to the top rail simply by forcibly sliding the cord runs 102 and/or 104 past an associated friction finger 70 in a cord bracket 58 of the bottom rail until the top rail and bottom rail are parallel. Once the rails are adjusted into a parallel relationship, however, the friction fingers and their grip on the cord runs will retain that parallel relationship unless an undue force is placed on the system and should that happen, it can be easily repositioned. Further, the leveling system also provides a convenient way of adjusting the desired maximum spacing between the top rail and the bottom rail and further for securing that desired maximum spacing with an anchoring system.

Figure 9:
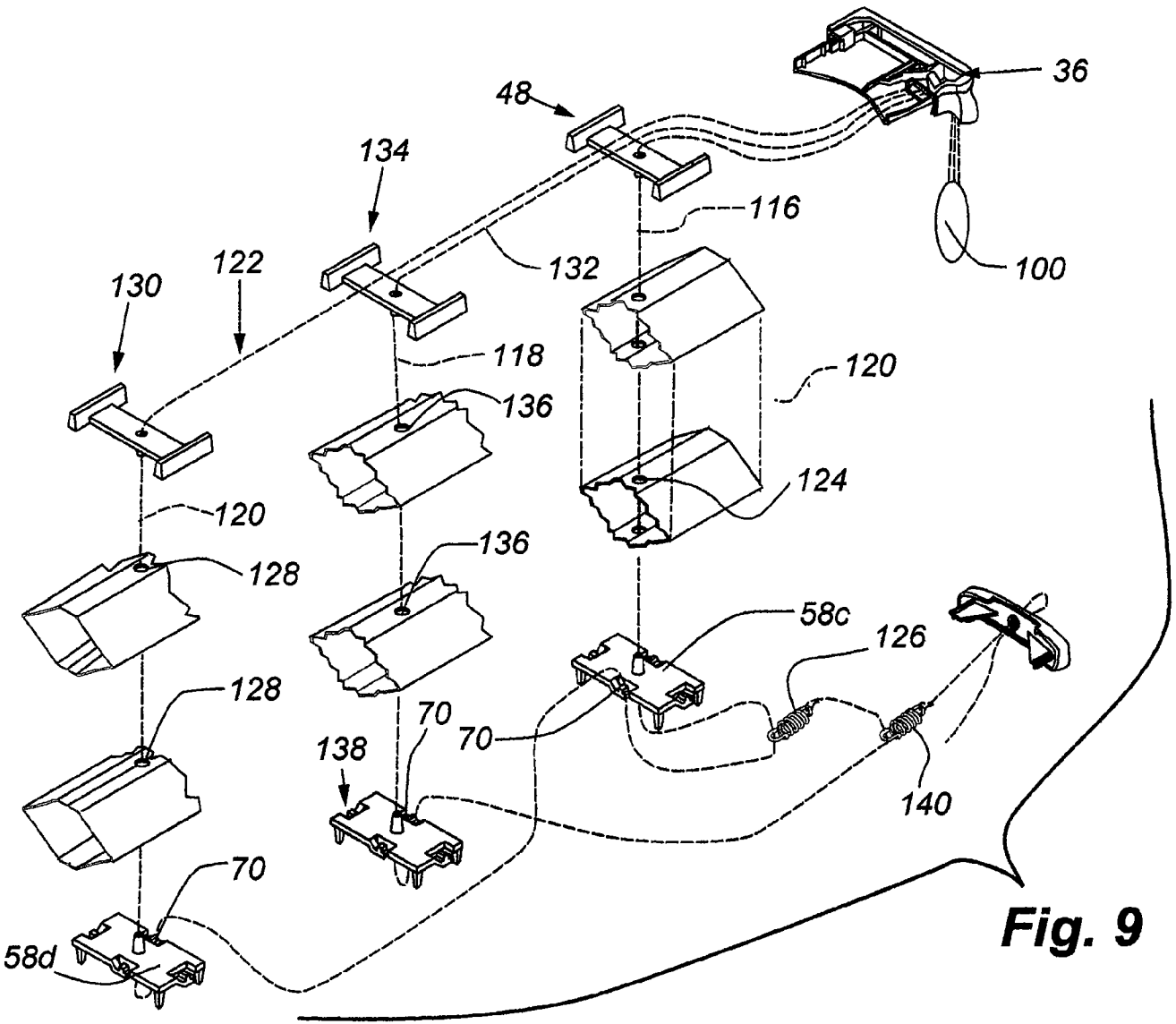
FIG. 9 is a diagrammatic isometric similar to FIG. 8 illustrating an embodiment of the invention wherein there are three vertical runs of lift cords for the covering.

With reference to FIG. 9, a diagrammatic illustration shows an embodiment of the invention where there are three vertical runs 116, 118 and 120 of lift cord which might be found, for example, in a covering that was wider than the covering illustrated in FIG. 7 and it was determined that the additional weight in the covering needed an additional run of lift cord for dependable operation. For purposes of describing the embodiment of FIG. 9, like parts have been given identical reference numerals. In the system of FIG. 9, a cord loop 122 extends from the tassel 100 where the ends of the main cord forming the loop are secured and with a first run 116 extending downwardly through the first encountered slide bracket 48 and holes 124 in the fabric 20 aligned therewith so it can pass down through a first cord bracket 58*c* of the bottom rail and from there slidably through a coil spring 126 before returning to the first encountered cord bracket 58*c* where it passes upwardly across a friction finger 70 on the bracket and from there transversely of the covering into and through a friction finger 70 of a third cord bracket 58*d*. After extending downwardly past the friction finger in the third cord bracket, it extends upwardly through the passage in the neck of the third cord bracket 58*d* and through associated aligned holes 128 of the fabric and upwardly through the passage of a third slide bracket 130 before returning through the top rail to the tassel 100. In addition to this loop of cord, a supplemental cord 132 having one end anchored within the tassel 100 also extends upwardly through the cord lock 36 and along the length of the top rail before extending downwardly through the neck of a second encountered slide bracket 134 and subsequently through aligned holes 136 in the fabric in the run 118 before extending downwardly through the neck of a second encountered cord bracket 138 in the bottom rail and upwardly past a friction finger 70 on the second encountered cord bracket before passing to a coil spring 140 and slidably through that coil spring for fixed connection to the opposite end of the coil spring 126 through which the looped cord 122 slidably passes. With this arrangement, it will be appreciated again the entire system can be operated with the tassel while retaining the bottom rail 18 in parallel relationship with the top rail 16, but the angular orientation of the bottom rail can be adjusted by forcibly sliding an appropriate cord past a friction finger. Similarly, the effective length of the anchor cord 88 can be adjusted for retaining the elevation of the bottom rail and its desired maximal spaced relationship from the top rail.

Figure 10:
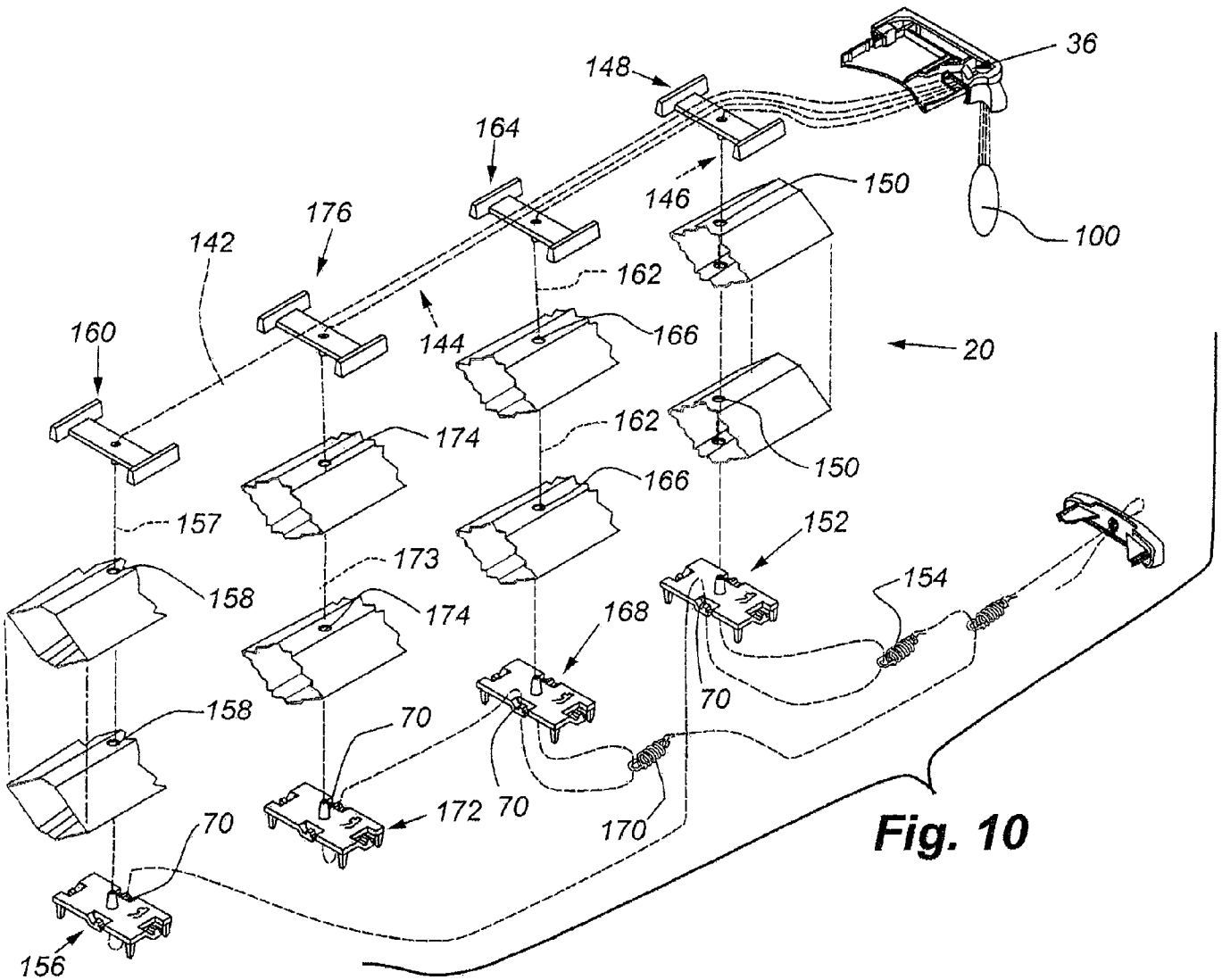
FIG. 10 is a diagrammatic isometric similar to FIG. 9 where there are four runs of lift cords.

Referring to FIG. 10, another embodiment of the invention is illustrated where four vertical runs of lift cord are desired. Again in this embodiment, like parts have been given like reference numerals. In this embodiment, there are two cord loops utilized with the first cord loop 142 being defined by a first main cord having its opposite ends secured to the tassel 100 and the second cord loop 144 similarly being defined by a second main cord with its ends secured to the tassel. The first cord loop has a first run 146 that extends upwardly from the tassel through the cord lock 36 and downwardly through the first encountered slide bracket 148 as well as the holes 150 in the fabric 20 therebeneath and through the neck of a first encountered cord bracket 152. Upon exiting the first cord bracket through the bottom, the run slidably passes through one end of a coil spring 154 and then returns to the first encountered cord bracket where it extends upwardly past a friction finger 70 and transversely of the covering to a fourth encountered cord bracket 156 where it extends downwardly past a friction finger 70 and subsequently upwardly through the neck of the fourth encountered cord bracket in a second run 157 and the aligned holes 158 in the fabric thereabove before passing through a fourth encountered slide bracket 160 and returning through the top rail 16 to the tassel.

The second cord loop 144 has its first run 162 emanating from the tassel and extending upwardly through the cord lock 36 and then along the top rail where it turns downwardly through a second encountered slide bracket 164 and the holes 166 in the fabric aligned therebeneath before extending through the neck of a second encountered cord bracket 168 and from the second encountered cord bracket it turns slidably to a third coil spring 170 and then returns upwardly through the second encountered cord bracket past a friction finger 70 before extending to a third encountered cord bracket 172 where it extends downwardly past a friction finger 70 and upwardly through the neck of the bracket for passage in a second run 173 through the aligned holes 174 in the fabric and a third encountered slide bracket 176 in the top rail before returning to the tassel.

It will be appreciated with this arrangement that again the orientation of the bottom rail can be easily adjusted by forcibly sliding an appropriate cord past a friction finger so the bottom rail and top rail are parallel with each other. Similarly, the desired maximum spacing between the top rail and bottom rail is achieved by adjusting the size of the cord loops above the bottom rail and anchoring the relationship through adjustment to the length of the anchor cord 88.

A further embodiment of the present invention is shown in FIGS. 11-17 with the embodiment being similar to that of FIGS. 1-8 but wherein the covering 180 is a top down/bottom up covering. Like parts have been given like reference numerals to those of the embodiment of FIG. 1. This embodiment of the invention includes a top rail 16 that is substantially identical to the top rail of the embodiment of FIG. 1 except that both ends of the top rail include an end cap having a cord lock 36 therein as the present embodiment is operative to not only lower and raise the bottom rail 18 of the covering but also an additional middle rail 182 so the covering functions as a top down/bottom up covering. In other words, the tassel 100 depending from the right end of the head rail is used for raising and lowering the bottom rail identical to that of the embodiment of FIG. 1 while a tassel 184 at the left end of the head rail is utilized for raising and lowering the middle rail.

Before describing the cord routing, it will be appreciated the top rail 16, with the exception of the end caps, is identical to that of FIG. 1 as mentioned previously, but instead of having a fabric connected thereto which is extendable downwardly across the entire architectural opening in which the covering is mounted a short segment of fabric 186 is provided which has, for example, three cells of a fabric material identical to that of the embodiment of FIG. 1. Those three cells provide a shallow light block and while being suspended from the top rail, it is not connected with the middle rail 182. A large segment 188 of identical fabric is suspended from the middle rail and extends to the bottom rail 18. The large segment of the fabric functions as the fabric of the embodiment of FIG. 1 so as to provide a retractable covering across an architectural opening in which the covering is mounted. As will be appreciated from the description that follows, the bottom rail can be lowered and raised to extend and retract the large segment of fabric and the middle rail can likewise be lowered or raised to collapse or extend the fabric. It will be appreciated the small segment of the fabric only engages the middle rail when the middle rail is raised so the middle rail is separable from the small segment (FIGS. 14 and 15) when it is lowered in a top down operation of the covering.

Figure 11:
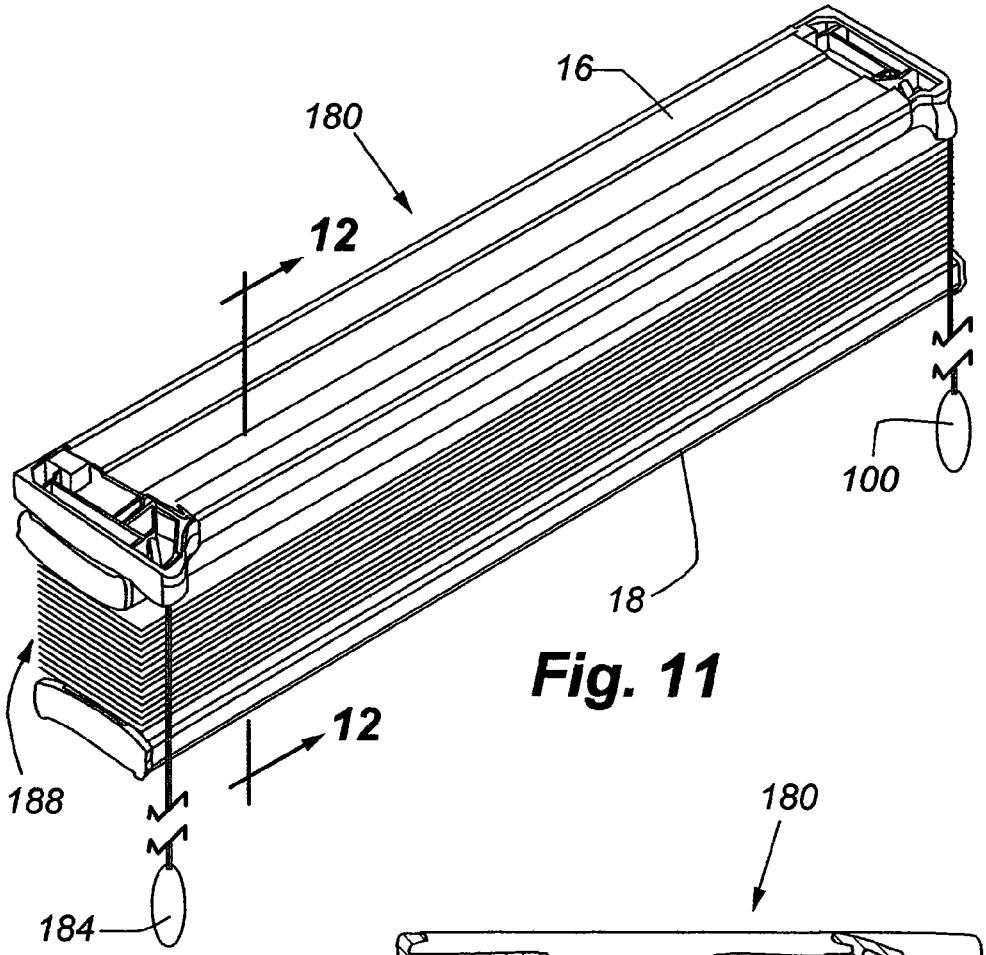
FIG. 11 is an isometric of a still further embodiment of the invention shown in a fully retracted position with the embodiment being a top down/bottom up covering.
Figure 13:
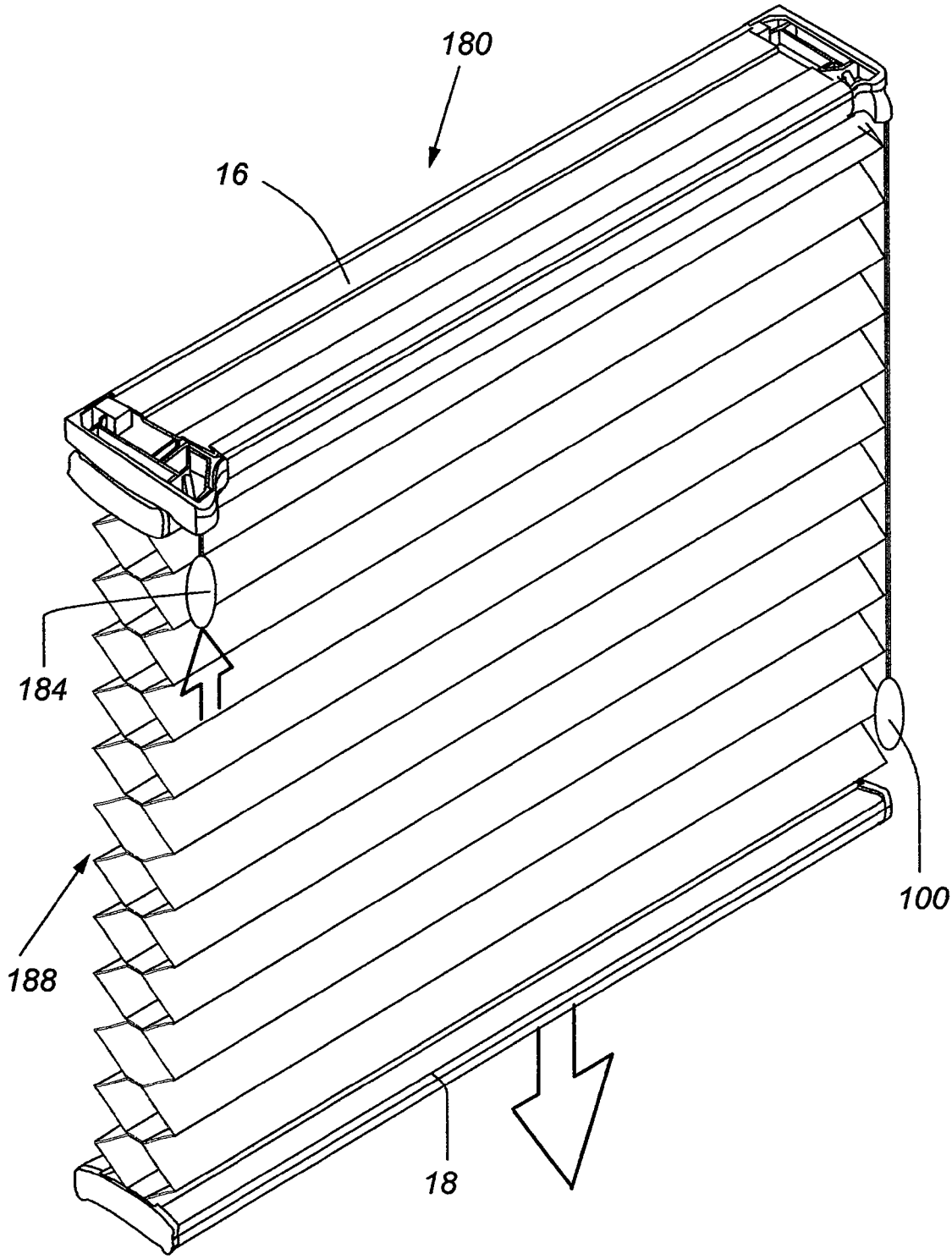
FIG. 13 is an isometric similar to FIG. 11 with the covering shown in a fully extended condition.
Figure 14:
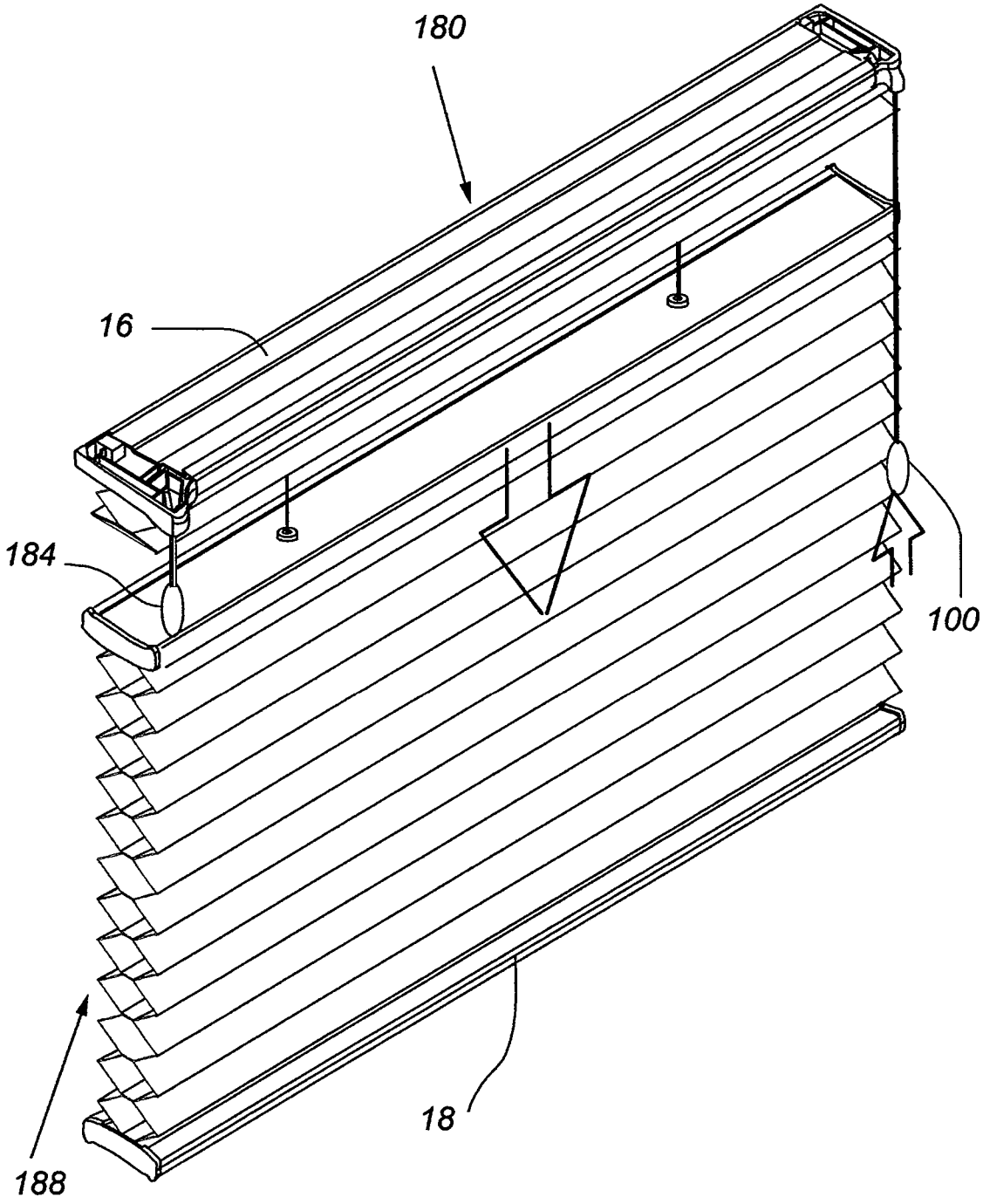
FIG. 14 is an isometric similar to FIG. 13 with the covering only partially extended from the top down.
Figure 15:
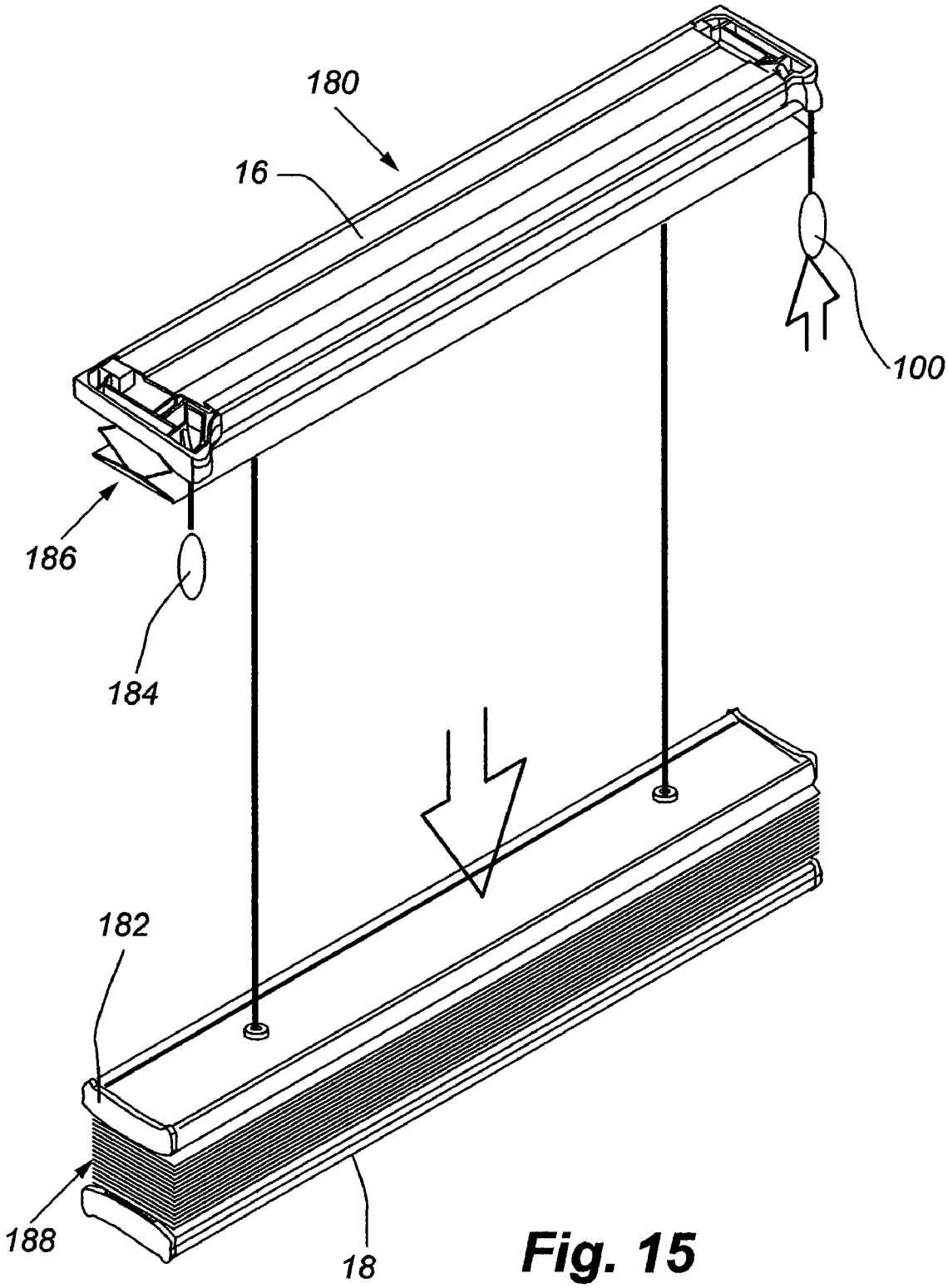
FIG. 15 is an isometric similar to FIG. 14 with the covering fully extended from the top down.

The operation of the covering 180 is probably best illustrated by reference to FIGS. 11 and 13-15. FIG. 11 shows the covering fully retracted with the middle rail 182 raised against the lower edge of the small segment 186 of fabric and the bottom rail 18 fully raised so the main or large segment 188 of fabric is fully compressed between the bottom rail and the middle rail. In FIG. 13, the bottom rail has been lowered without moving the middle rail so the main segment of fabric would extend across the architectural opening in which the covering is mounted. If it were desired to lower the top edge of the fabric from the condition shown in FIG. 13, the middle rail is lowered as shown in FIG. 14 establishing a gap between the small segment of fabric and the middle rail with the main segment of fabric beginning to be compressed between the middle rail and the fully extended or lowered bottom rail. When the middle rail has been fully extended to its lowermost position and the bottom rail is also lowered to its lowermost position as shown in FIG. 15, the main segment of fabric is collapsed between the middle and bottom rails so that a full gap is defined between the middle rail and the small segment of fabric. The small segment of fabric may or may not be desired for the present embodiment but is included, as mentioned, as establishing a light block at the top of the covering which is sometimes desirable. If it were not utilized, the middle rail would simply be raised into engagement with the top rail when it was fully retracted and the small segment would not be existent therebetween.

Figure 12:
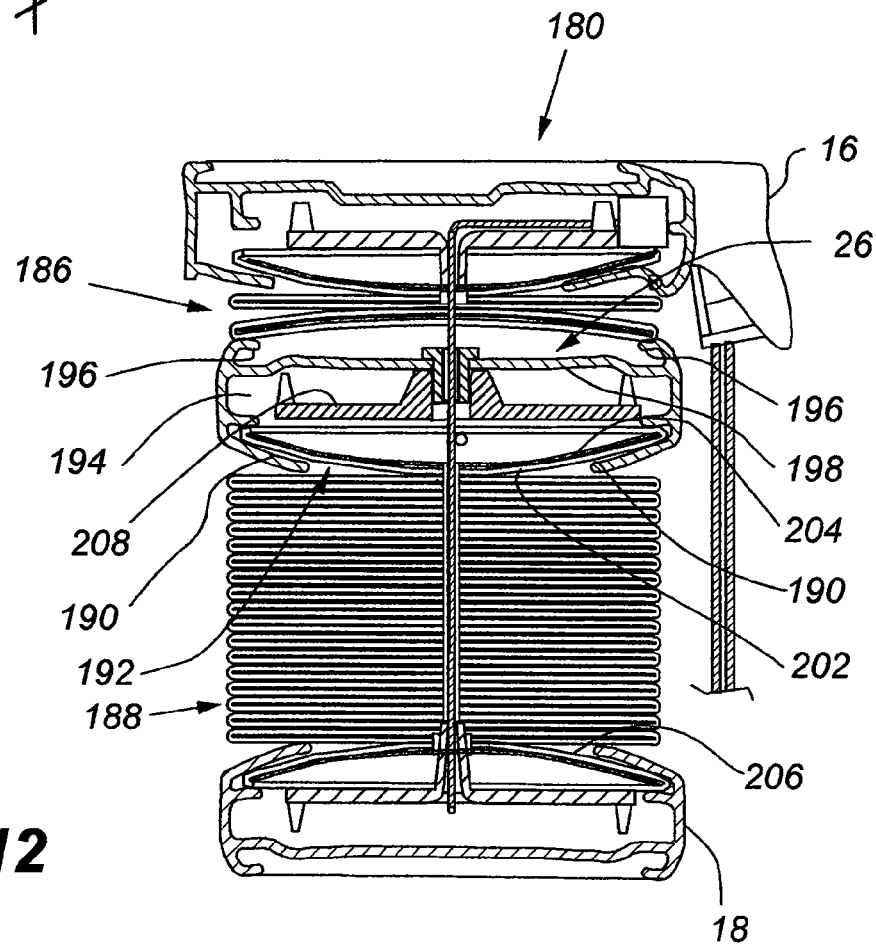
FIG. 12 is an enlarged section taken along line 12-12 of FIG. 11.
Figure 16A:
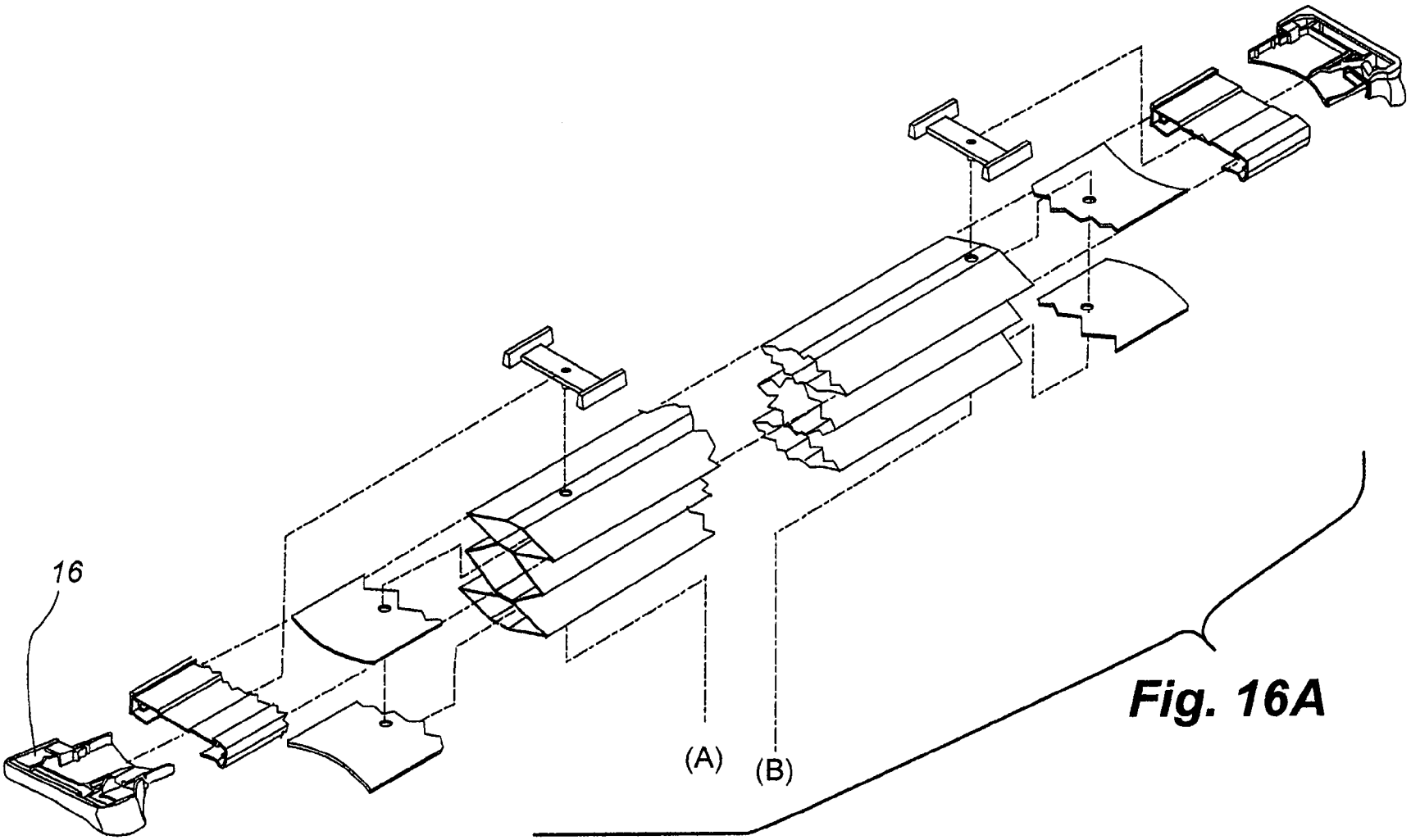
FIG. 16A is an exploded fragmentary isometric showing the top rail and associated parts for the embodiment shown in FIG. 11.
Figure 16B:
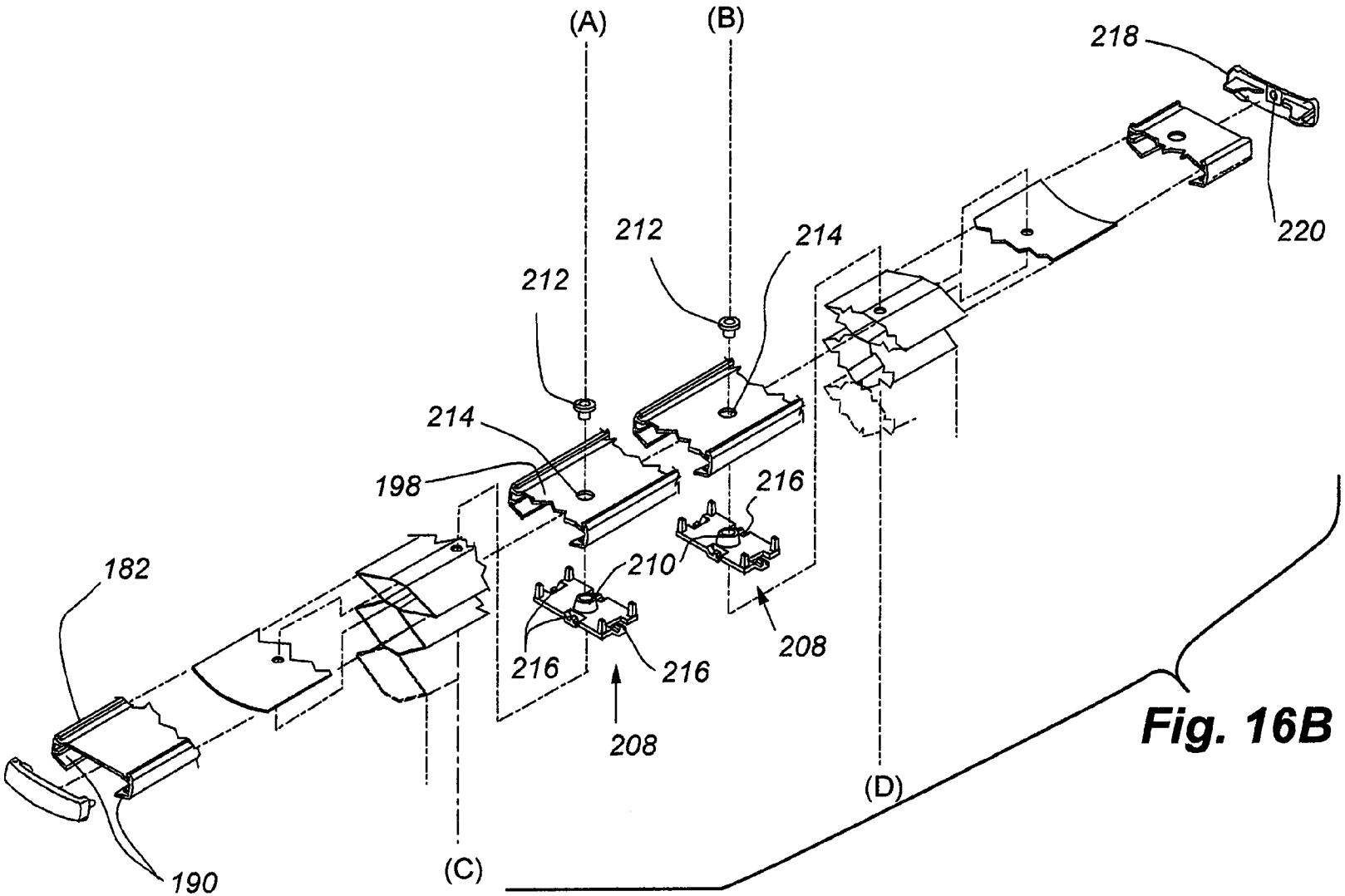
FIG. 16B is a fragmentary exploded isometric similar to FIG. 16A showing the middle rail used in the embodiment of FIG. 11.
Figure 16C:
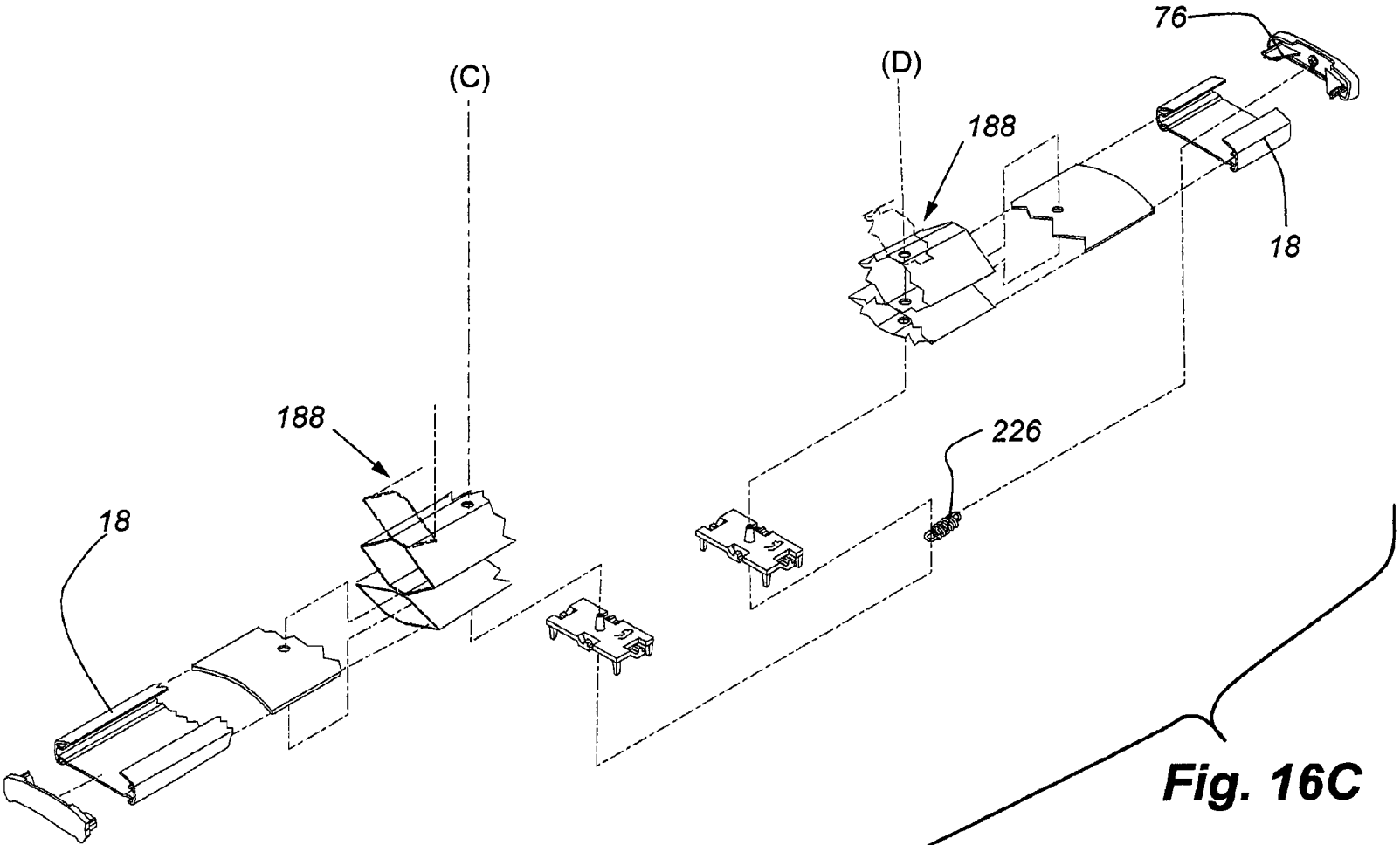
FIG. 16C is a fragmentary exploded isometric similar to FIGS. 16A and 16B showing the bottom rail and related components of the embodiment of FIG. 11.

Since the top 16 and bottom 18 rails of the embodiment of FIG. 11 are identical to that of FIG. 1, they will not be fully described again but the middle rail 182 is probably shown best in FIGS. 12 and 16B. There it will be seen that the middle rail is again an extruded component having inturned longitudinally extending lips 190 along the lower surface thereof defining a gap 192 therebetween which communicates with a lower chamber 194 of the middle rail. Further, the middle rail has a pair of inturned upper lips 196 above a top wall 198 with the upper lips defining an abutment surface for engagement with the small fabric segment 186 when the middle rail is raised. The upper lips also cooperate with the top wall in defining an upper chamber 200 for a purpose to be described hereafter.

Similarly to the top rail 16 of the embodiment of FIG. 1, the uppermost cell 202 of the main segment of fabric is fixed within the lower chamber 194 of the middle rail 182 with a rigid or semi-rigid anchor strip 204 that is inserted through the uppermost cell and positioned above the inturned lips 190 along the bottom of the middle rail so as to secure the uppermost cell to the middle rail. Of course, the lowermost cell 206 is secured to the bottom rail 18 in the manner previously described in connection with the embodiment of FIG. 1.

Positioned internally of the middle rail 182 in the lower chamber 194, as seen best in FIGS. 12 and 16B, are cord brackets 208 very similar to those used in the bottom rail except they have an upstanding hollow neck 210 that frictionally receives or is otherwise secured to an anchor cap 212 that extends through a passage 214 in the top wall 198 so the closure cap secures the associated anchor bracket to the top wall and within the lower chamber 194 of the middle rail. The cord bracket has friction fingers 216 along each of its four sides for cooperating with lift cords in the manner described with the previous embodiments of the invention. It should also be appreciated the middle rail has end caps 218 which substantially match in contour the cross-sectional configuration of the middle rail but provide aesthetic closure to the extruded middle rail. The end cap at the right end of the middle rail as viewed in FIG. 16B has a passage 220 therethrough identical to the end cap 76 in the bottom rail so an anchor cord 88 can be adjustably secured to this end cap as described in connection with the embodiment of FIG. 1.

Figure 17:
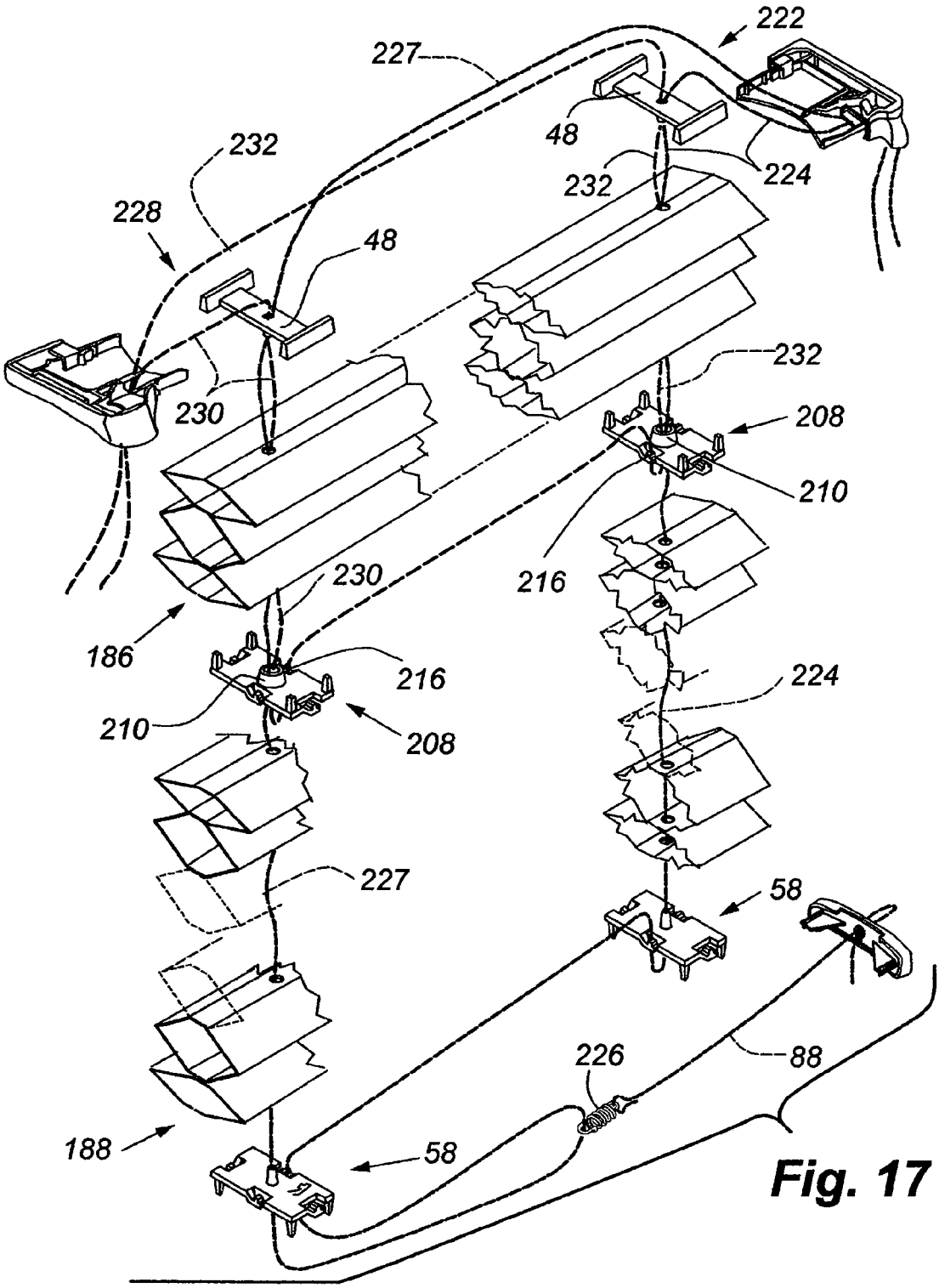
FIG. 17 is an exploded fragmentary isometric illustrating the routing of the lift cords for the embodiment of FIG. 11.
Figure 19:
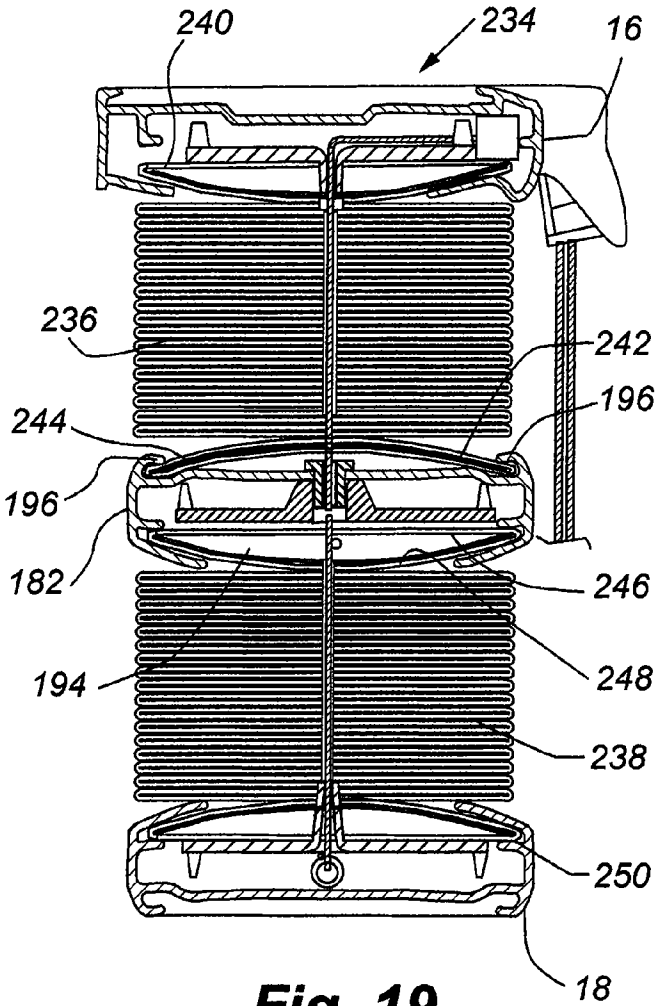
FIG. 19 is an enlarged section taken along line 19-19 of FIG. 18.
Figure 18:
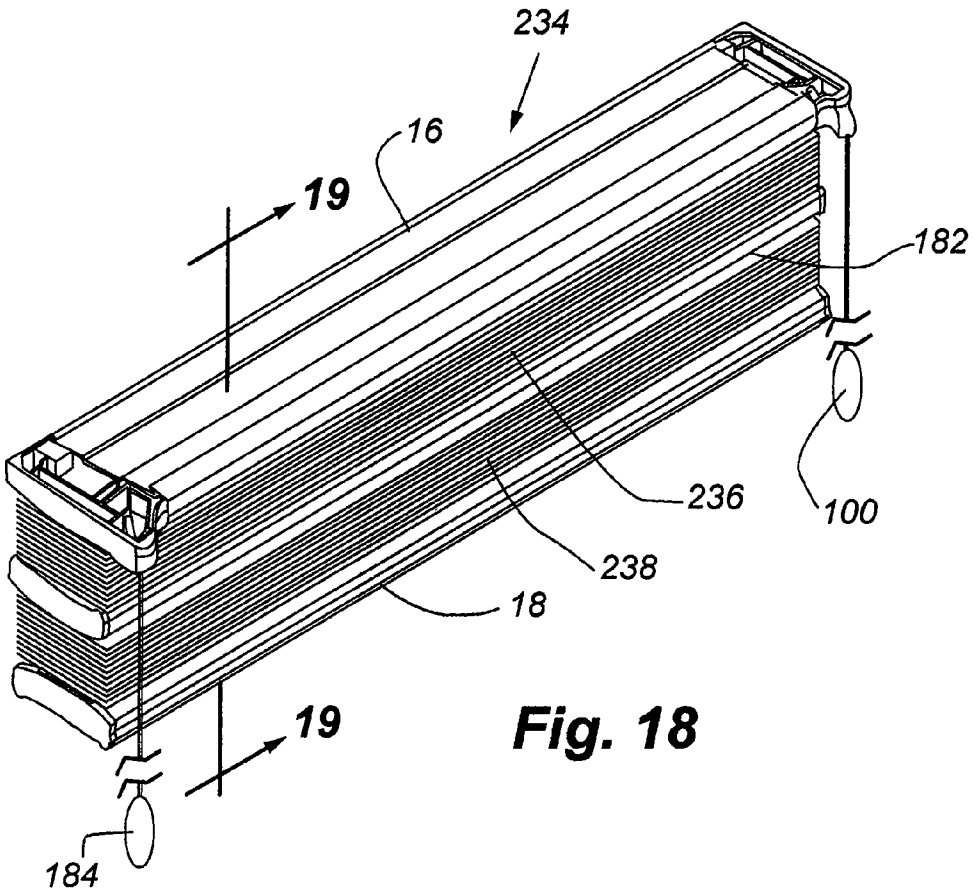
FIG. 18 is an isometric of a further embodiment of the present invention shown in a fully retracted position with the embodiment illustrating a covering having top and bottom rails along with a middle rail and fabric extending between the respective rails.

Referring to FIG. 17, it will be appreciated there are two cord loops utilized as lift cords for the embodiment of FIGS. 11-17 with the first cord loop 222 being identical to that described in connection with the embodiment of FIG. 1 so the ends of the cord defining the cord loop are secured in the tassel 100 (FIG. 11) and a first run 224 of the cord loop extends downwardly through the short fabric 186 and through the central neck 210 of the cord bracket 208 in the middle rail 182 for passage to the aligned cord bracket 58 in the bottom rail 18 where it is slidably connected to a coil spring 226 which in turn is connected at its opposite end to the anchor cord 88 and returns to the tassel 100 in a second run 227 through the other cord bracket 58 in the bottom rail and the cord bracket 208 in the middle rail and subsequently through the aligned slide bracket 48 in the top rail 16. It will therefore be appreciated that the bottom rail is moved identically to that of the embodiment of FIG. 1 through manipulation of the tassel 100 at the right end of the covering.

A second loop 228 of lift cord is formed from a flexible cord having its ends anchored in the tassel 184 (FIG. 11) at the left end of the head rail 16 with the second cord loop having a first run 230 that extends downwardly through the small fabric segment 186 and through an aligned cord bracket 208 in the middle rail 182 where it turns upwardly across a friction finger 216 on that cord bracket closest to the opposite cord bracket in the middle rail and then across to the opposite cord bracket in the middle rail where it passes over the confronting friction finger 216 of the opposite cord bracket and then up through the central neck 210 of the opposite cord bracket in a second run 232 and through the small fabric segment before returning to and through the head rail to the left end cap and subsequently to the tassel 184 at the left end of the head rail. It will be appreciated the second cord loop is substantially similar to the first cord loop only reversed so the middle rail can be raised and lowered through manipulation of the tassel at the left end of the head rail independently of the movement of the bottom rail by the tassel at the right end of the head rail. The middle rail can also be leveled identically to the bottom rail by forcefully changing the elevation of the middle rail by forcing the second loop of lift cord to slide past the friction fingers with which it is engaged.

Another embodiment 234 of the invention is shown in FIGS. 18-24 where like parts have been given like reference numerals to those shown in the embodiment of FIGS. 11-17. This embodiment is identical to that of FIGS. 11-17 except there are upper 236 and lower 238 main segments of fabric and the small segment of fabric has been removed. In other words, there is an upper main segment 236 and a lower main segment 238 with each being identical for purposes of disclosure even though they could be different sizes or fabrics and the covering would still operate the same. The upper main segment of fabric is secured to the top rail 16 with its uppermost cell 240 (FIG. 19) and the lowermost cell 242 of the upper segment is secured to the middle rail 182 with a further anchor strip 244 that is extended through the lowermost cell and confined beneath the upper lips 196 running along the length of the top of the middle rail. The lower main segment is connected at its uppermost cell 246 to the middle rail with an anchor strip 248 in the lower chamber 194 and the lowermost cell 250 is connected to the bottom rail 18 identically to that of FIGS. 11-17.

Figure 20:
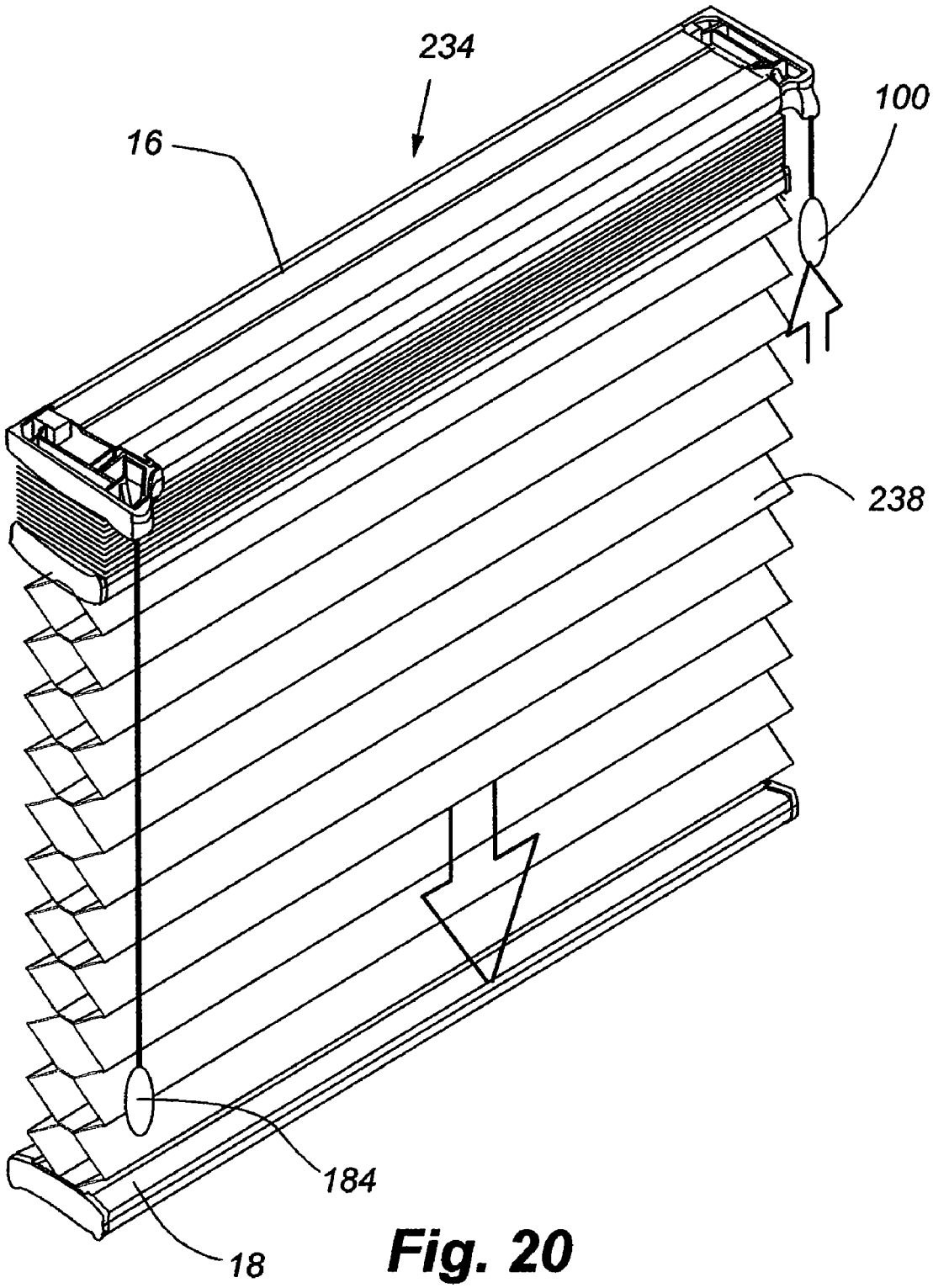
FIG. 20 is an isometric showing the lower half of the covering of FIG. 18 fully extended while the upper half is fully retracted.
Figure 21:
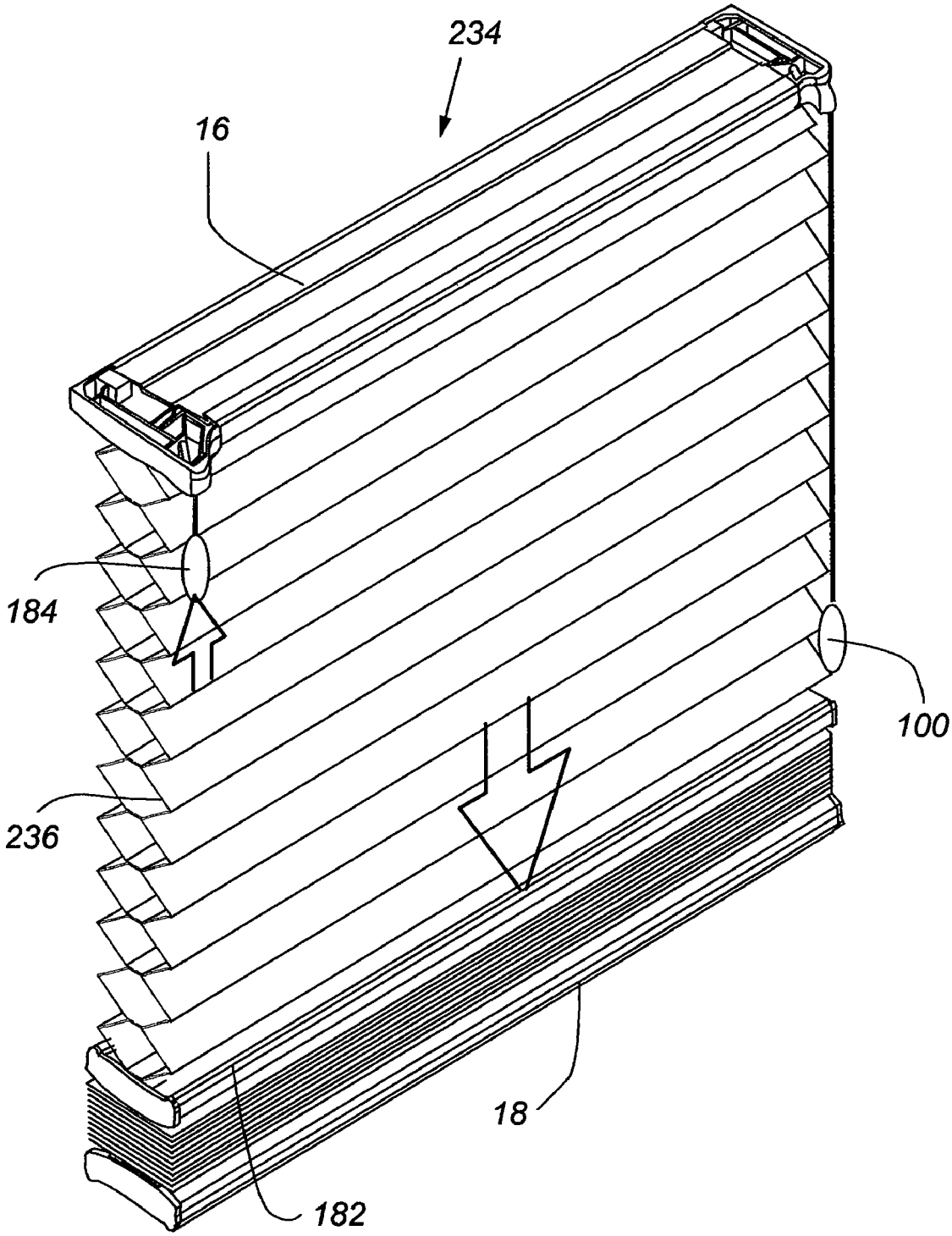
FIG. 21 is an isometric similar to FIG. 20 with the upper half of the covering fully extended and the lower half fully retracted.
Figure 22:
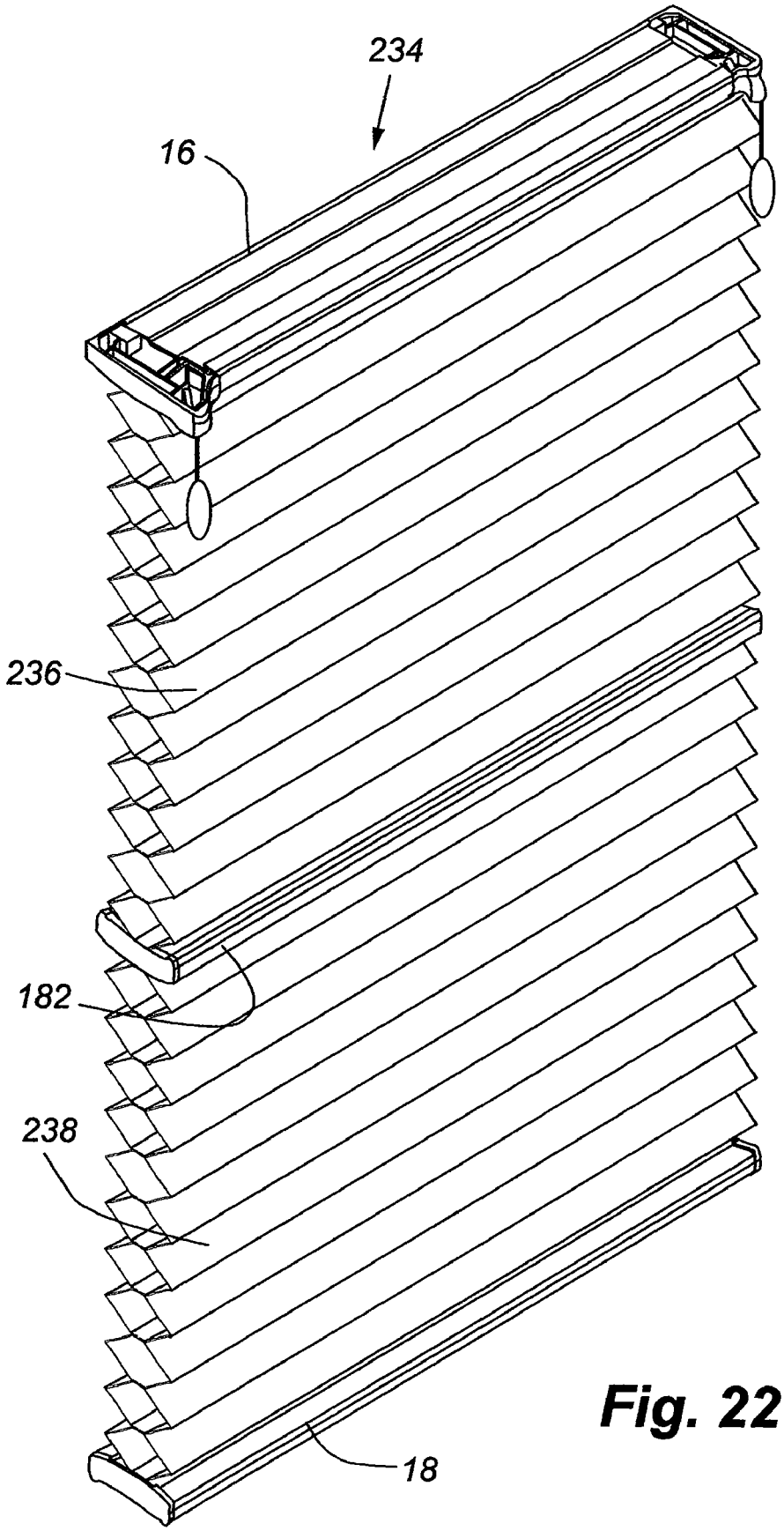
FIG. 22 is an isometric similar to FIG. 21 showing both the upper and lower halves of the covering fully extended.
Figure 23A:
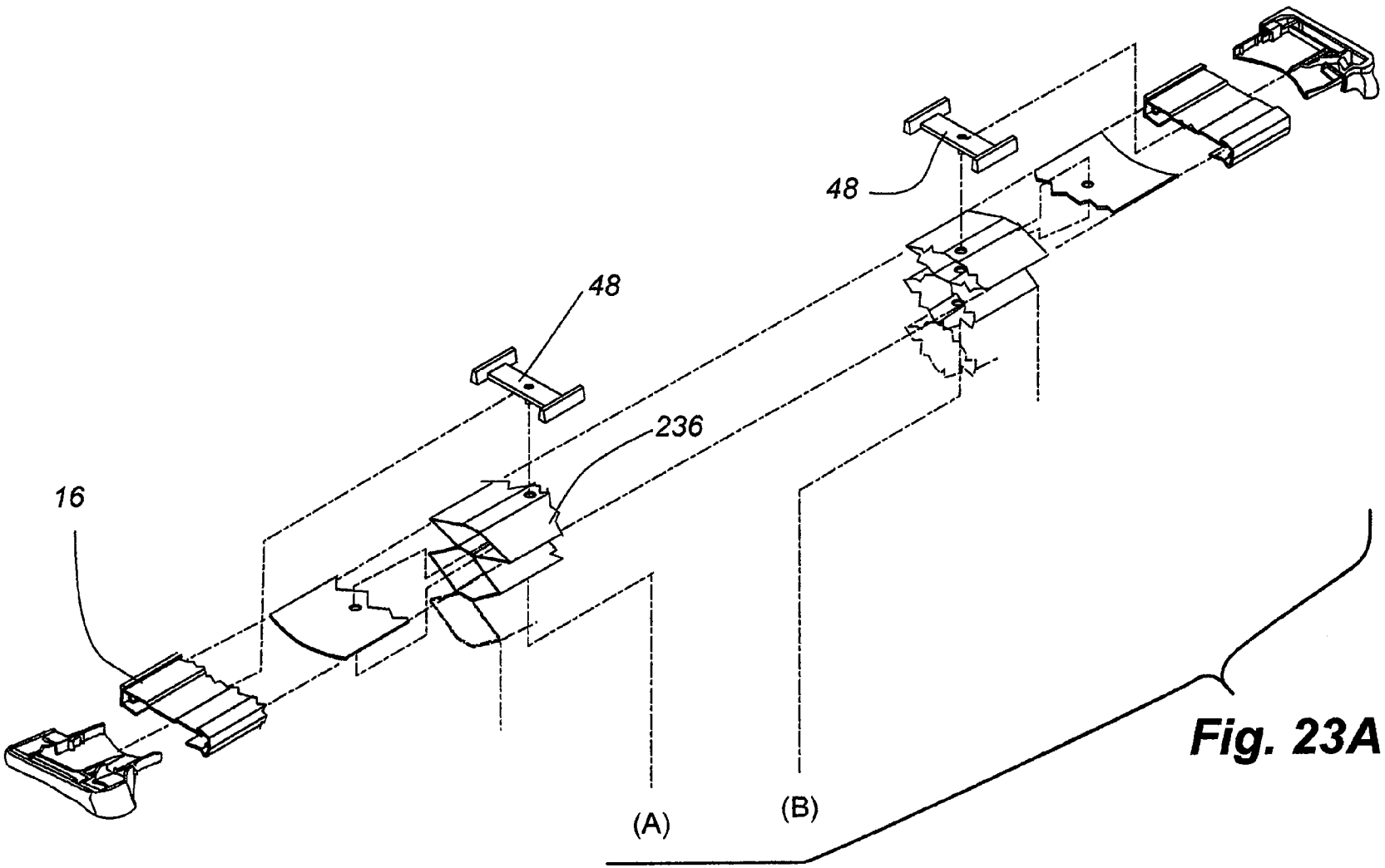
FIG. 23A is a fragmentary exploded isometric of the top rail and associated components for the embodiment of FIG. 18.
Figure 23B:
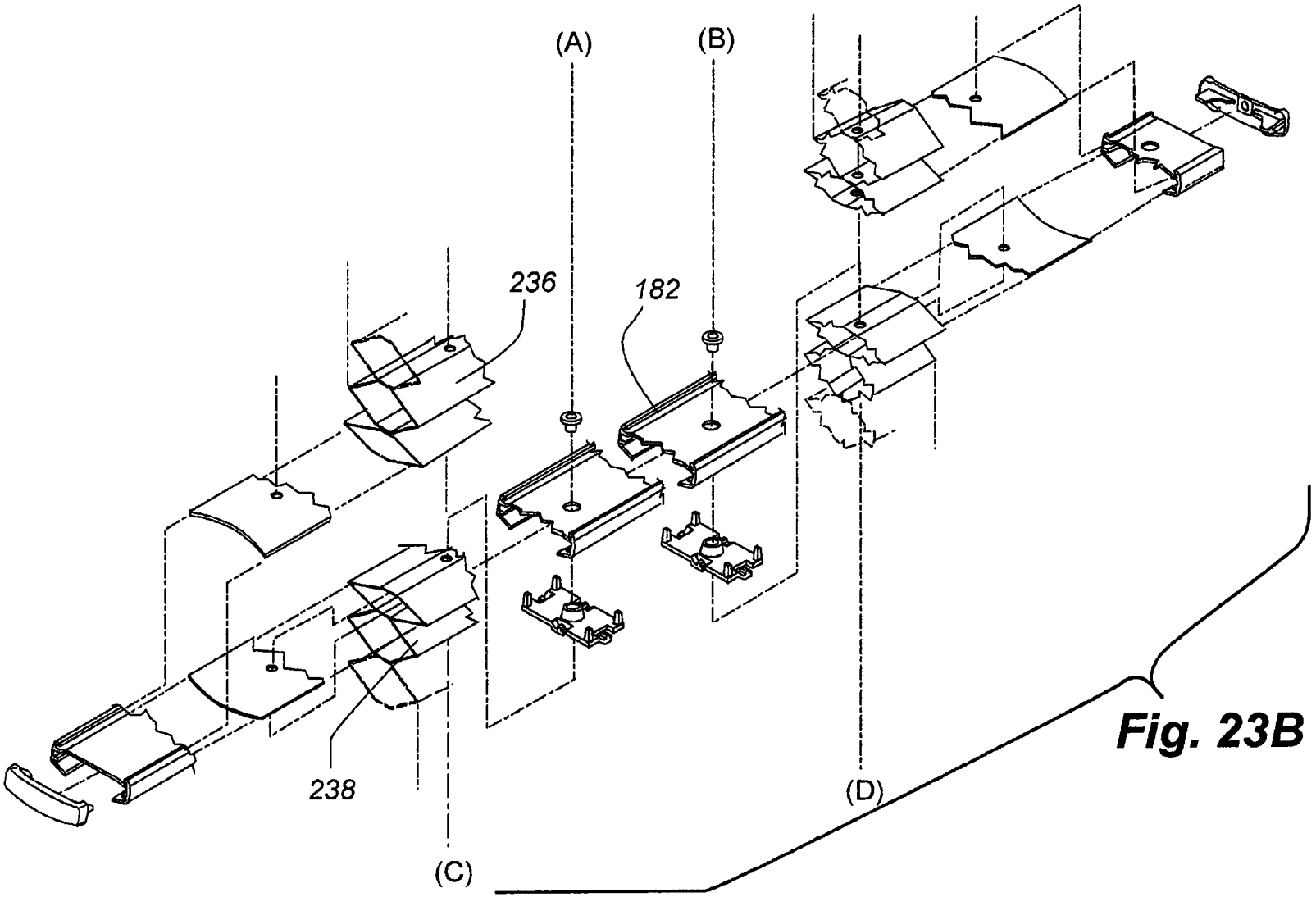
FIG. 23B is a fragmentary exploded isometric similar to FIG. 23A showing the middle rail of the embodiment of FIG. 18.
Figure 23C:
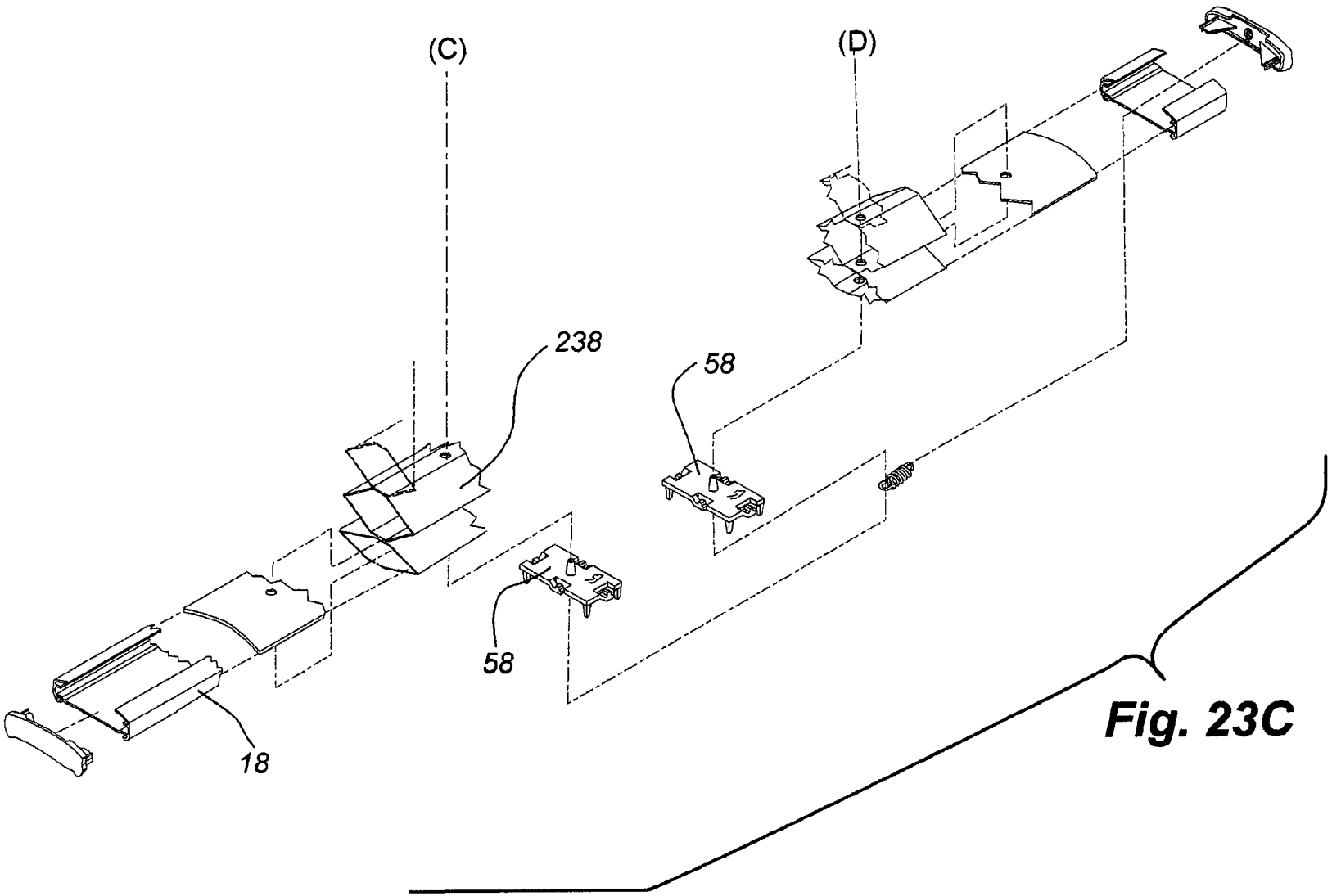
FIG. 23C is a fragmentary exploded isometric similar to FIGS. 23A and 23B showing the bottom rail and related components of the embodiment of FIG. 18.
Figure 24:
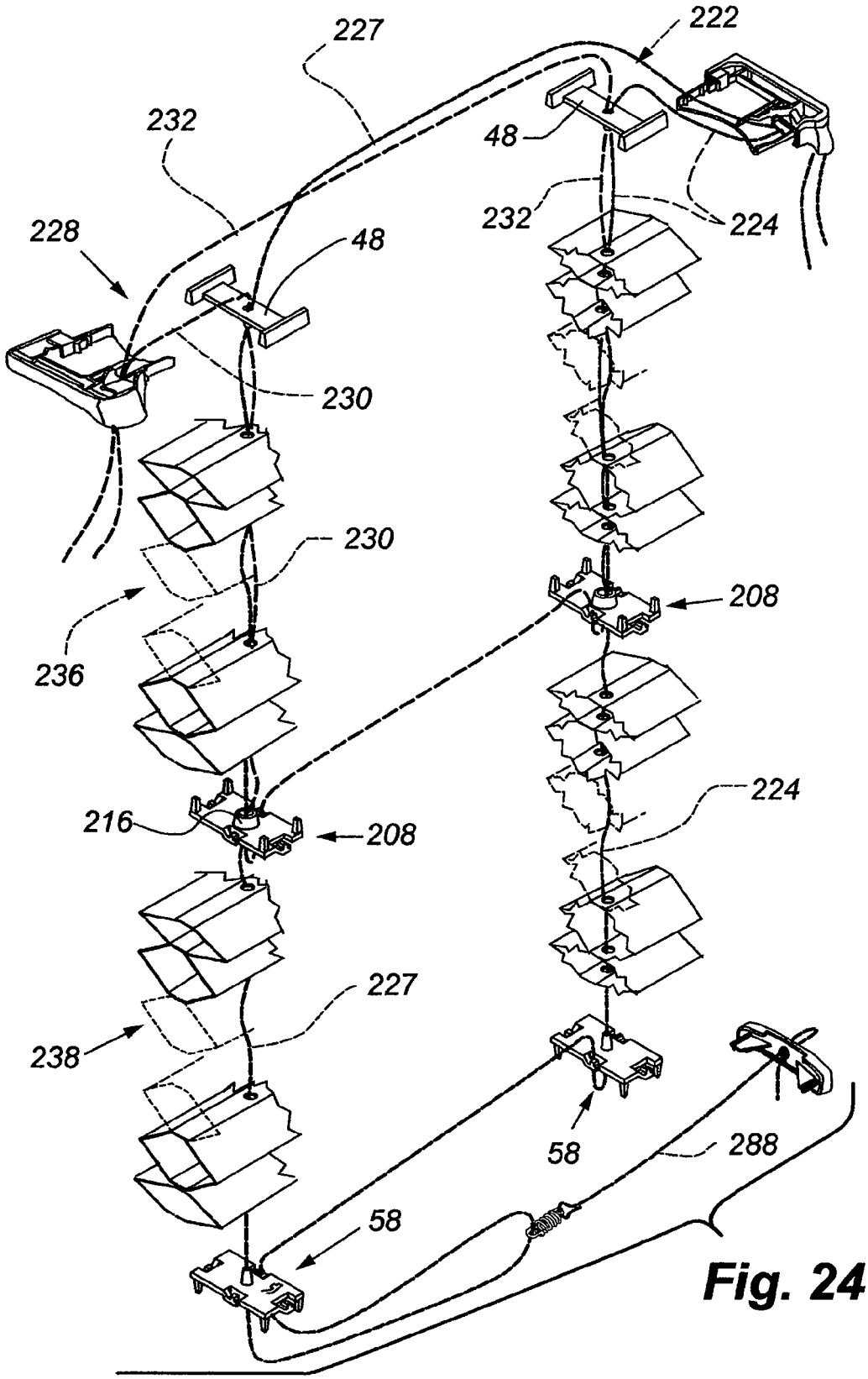
FIG. 24 is an exploded fragmentary isometric illustrating the cord routing of the embodiment of FIG. 18.
Figures 25, 26:
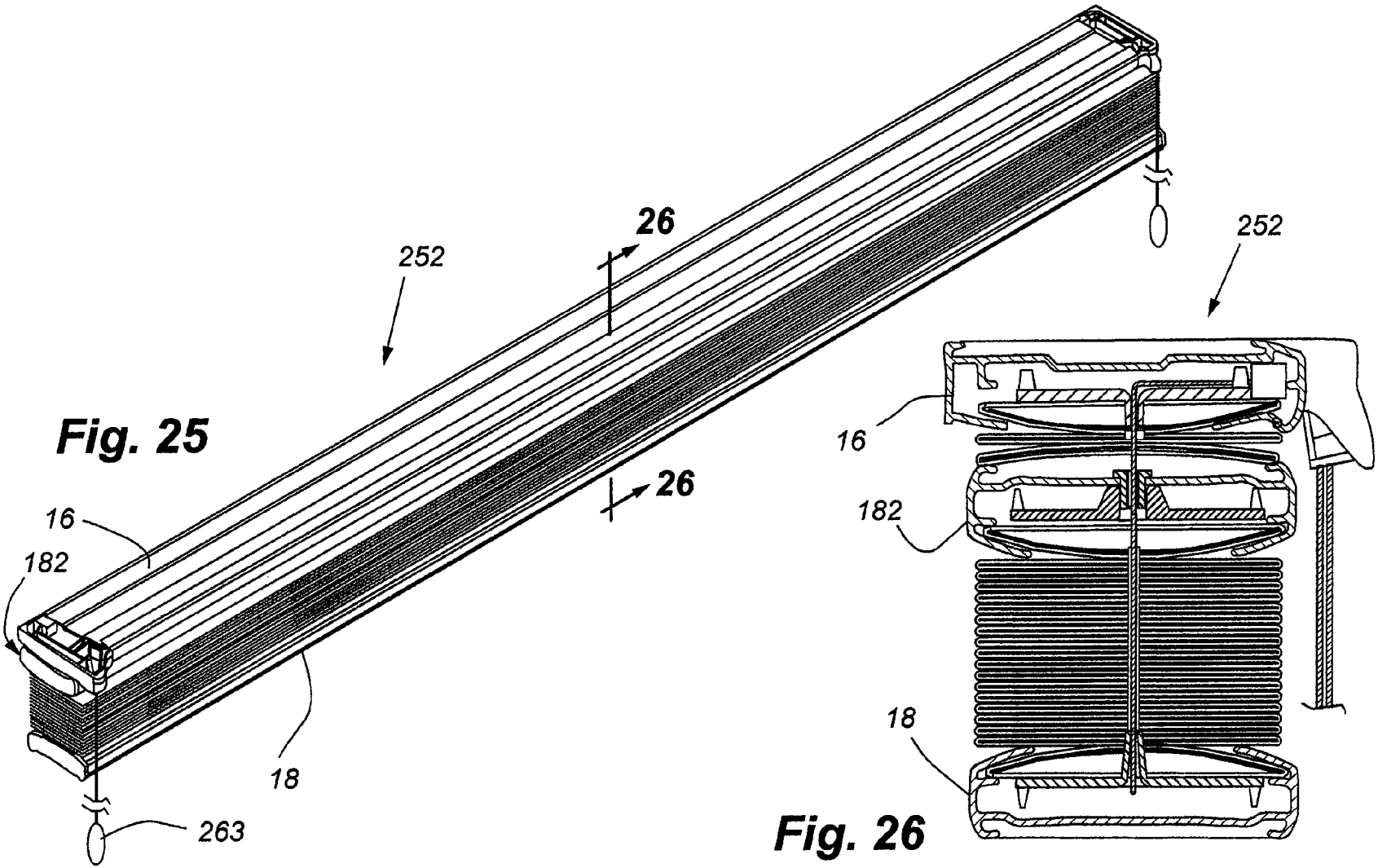
FIG. 25 is an isometric of a still further embodiment of the invention illustrating a top down/bottom up covering similar to the embodiment of FIG. 11 except where there are three lift cords as opposed to two.
FIG. 26 is an enlarged section taken along line 26-26 of FIG. 25.
Figure 27:
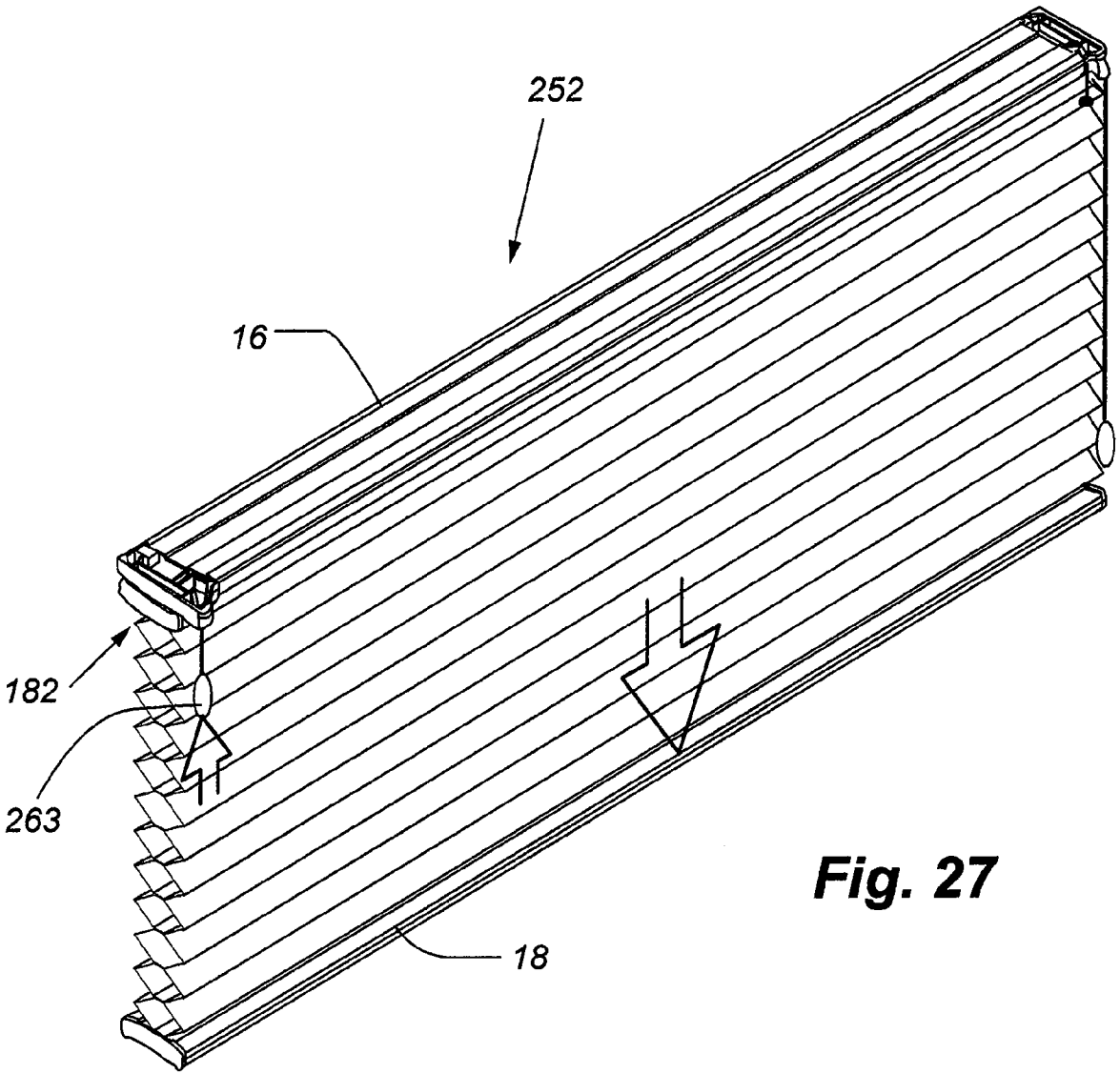
FIG. 27 is an isometric of the covering of FIG. 25 in an extended condition.
Figure 28:
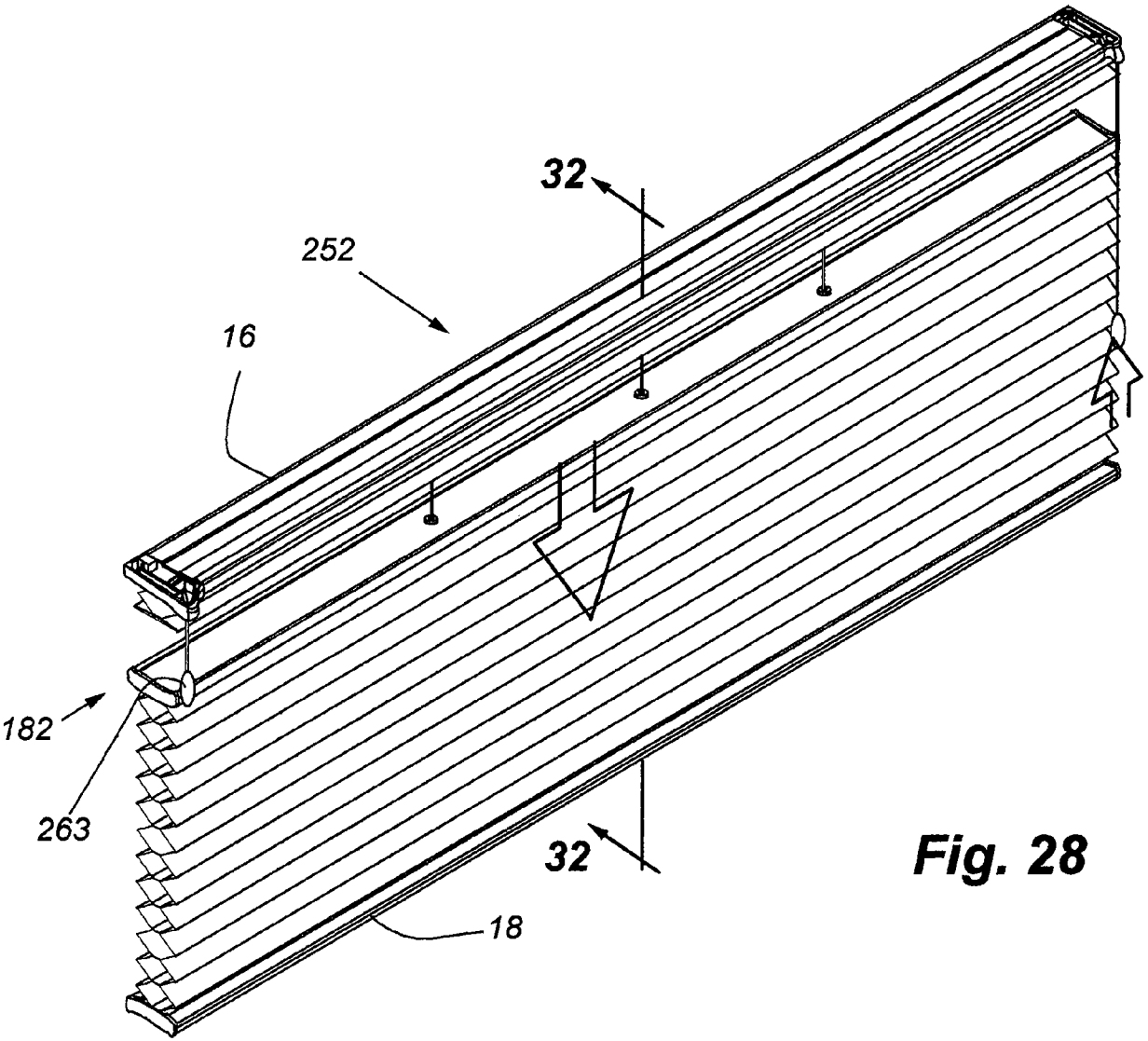
FIG. 28 is an isometric similar to FIG. 27 with the covering partially extended from the top down.
Figure 29:
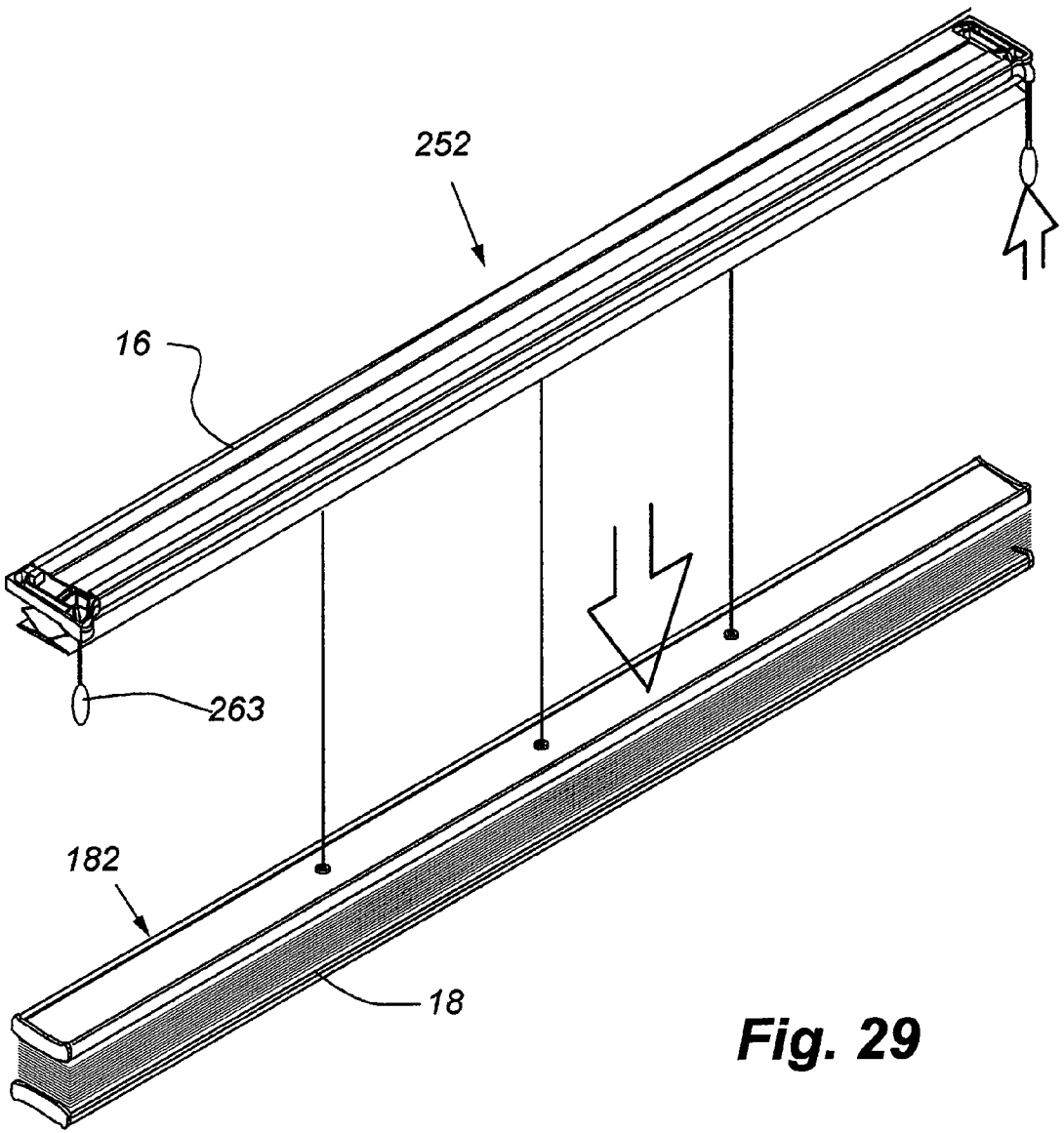
FIG. 29 is an isometric similar to FIG. 28 with the covering fully extended from the top down.
Figure 30A:
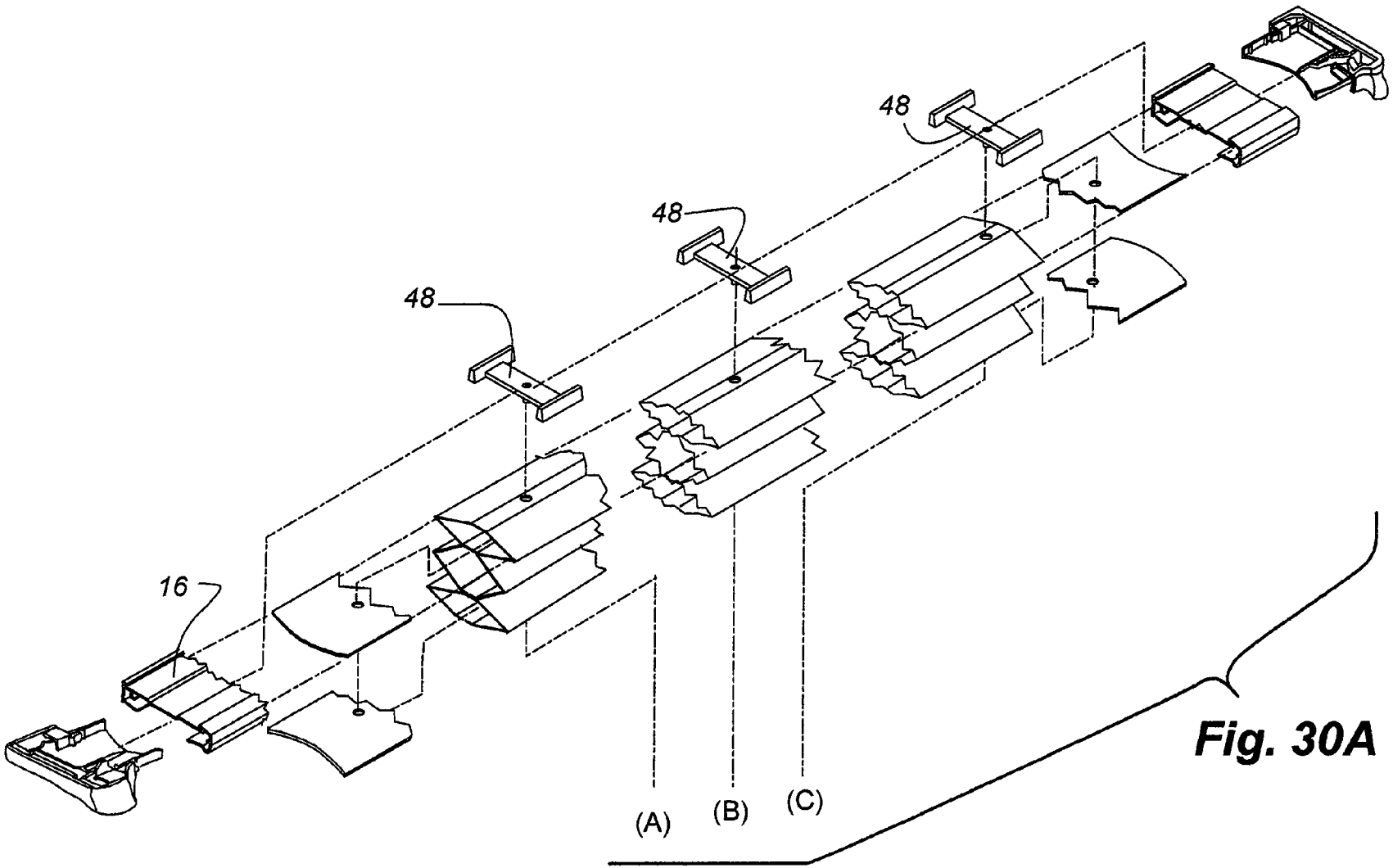
FIG. 30A is an exploded fragmentary isometric of the top rail and its related components of the embodiment of FIG. 25.
Figure 30B:
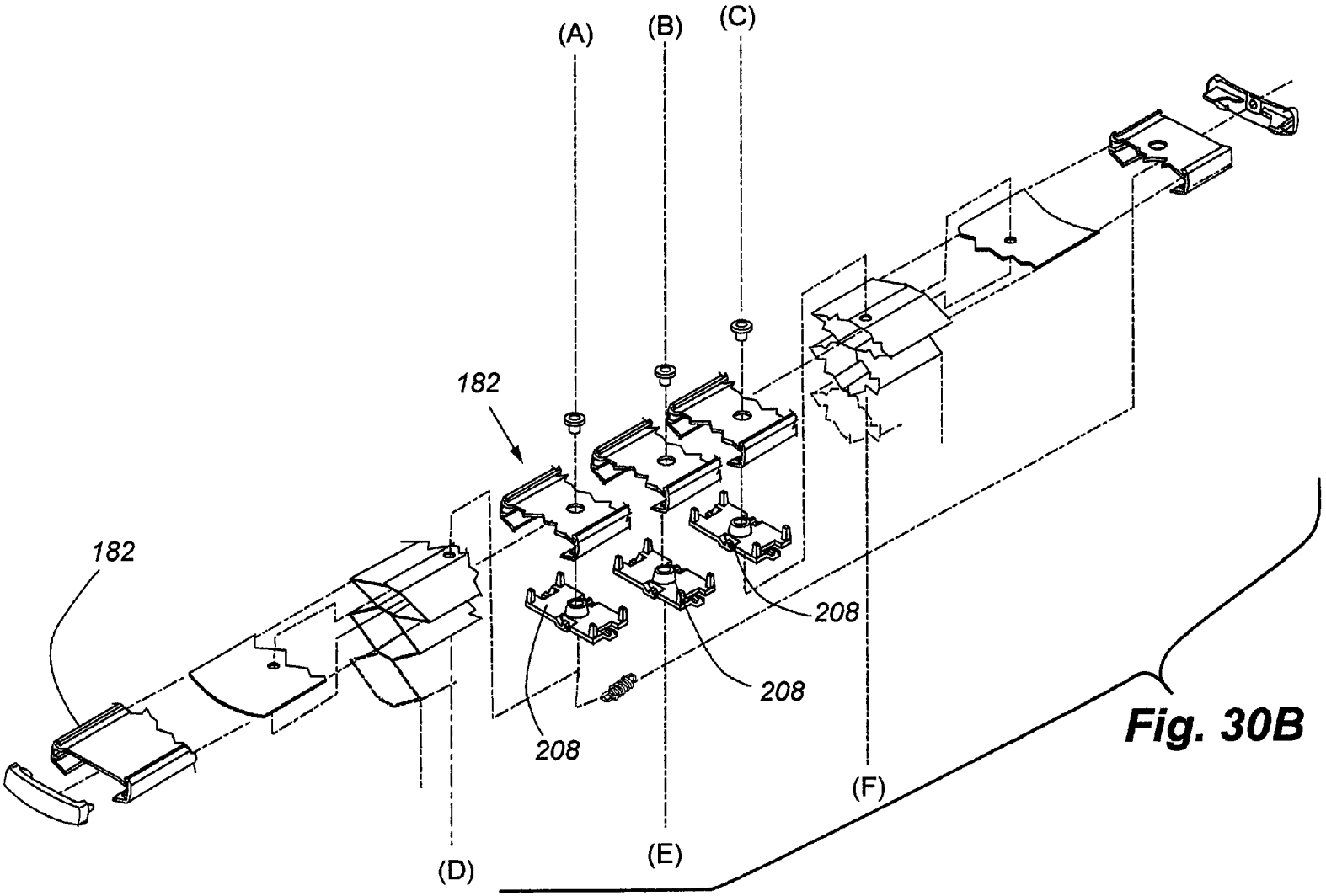
FIG. 30B is a fragmentary exploded isometric similar to FIG. 30A of the middle rail of the embodiment of FIG. 25.
Figure 30C:
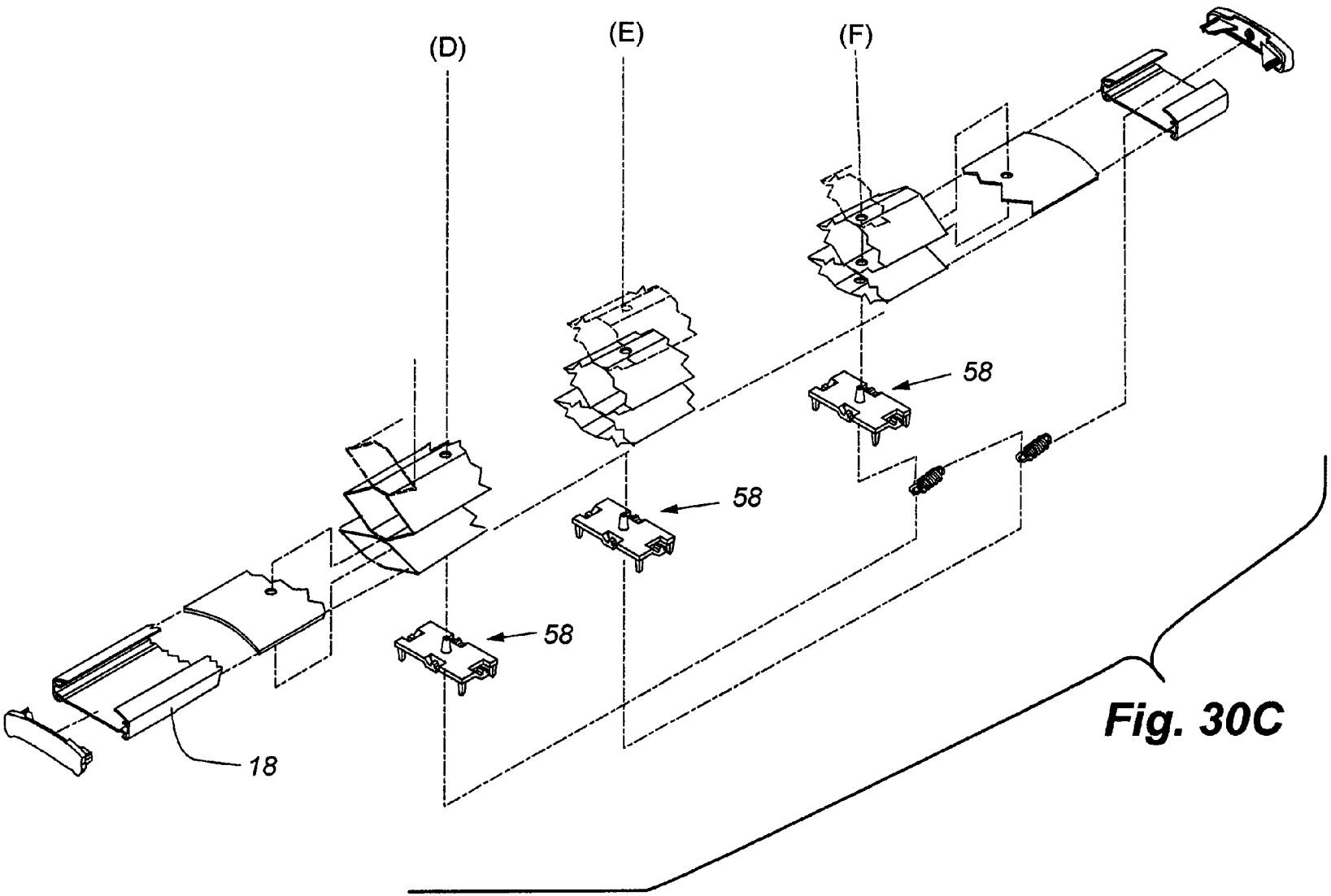
FIG. 30C is an exploded fragmentary isometric similar to FIGS. 30A and 30B of the embodiment of FIG. 25.

The cord routing for the embodiment of FIGS. 18-24 is seen best in FIG. 24 and it will there be appreciated it is identical to that of the embodiment of FIGS. 11-17 so that again the bottom rail 18 can be raised and lowered through manipulation of a tassel 100 at the right end of the head rail 16 and the middle rail 182 can be raised and lowered with a tassel 184 at the left end of the head rail. Accordingly, through appropriate manipulation of the middle rail and the bottom rail, the upper 236 and lower 238 main segments of fabric can be selectively distributed across the architectural opening in which the covering is mounted. For example, as shown in FIG. 20, the lower main segment of fabric has been extended while the upper main segment is fully retracted. In FIG. 21, the upper main segment is fully extended while the lower main segment is fully retracted. FIG. 22 shows both the upper and lower segments extended with the middle rail positioned an equidistance between the top rail and the bottom rail.

A still further embodiment of the present invention is shown in FIGS. 25-32. In this embodiment, the structural components of the covering 252 of this embodiment are identical to that of the embodiment of FIGS. 11-17, but the lift cord system is different. In the embodiment of FIGS. 25-32, there are three cord brackets 208 in the middle rail 183, three cord brackets 58 in the bottom rail 18 and three slide brackets 48 in the top rail 16 for guiding runs of lift cords through the covering with it being understood the width of the covering and consequently its overall weight dictates the number of vertical runs of lift cords desired for operating the blind. For example, the blind illustrated in FIGS. 11-17 is relatively narrow and two runs of lift cord are adequate for the weight of the covering. The covering illustrated in FIG. 25, however, is shown as being wider and therefore heavier so that additional lift cords are desired for handling the weight. Inasmuch as the structural components of the shade of the covering of the embodiment of FIGS. 25-31 are identical to that of the embodiment of FIGS. 11-17, a repeat of the description thereof is not deemed necessary. Rather, only a description of the lift cord routing illustrated in FIG. 31 will be described.

Figure 31:
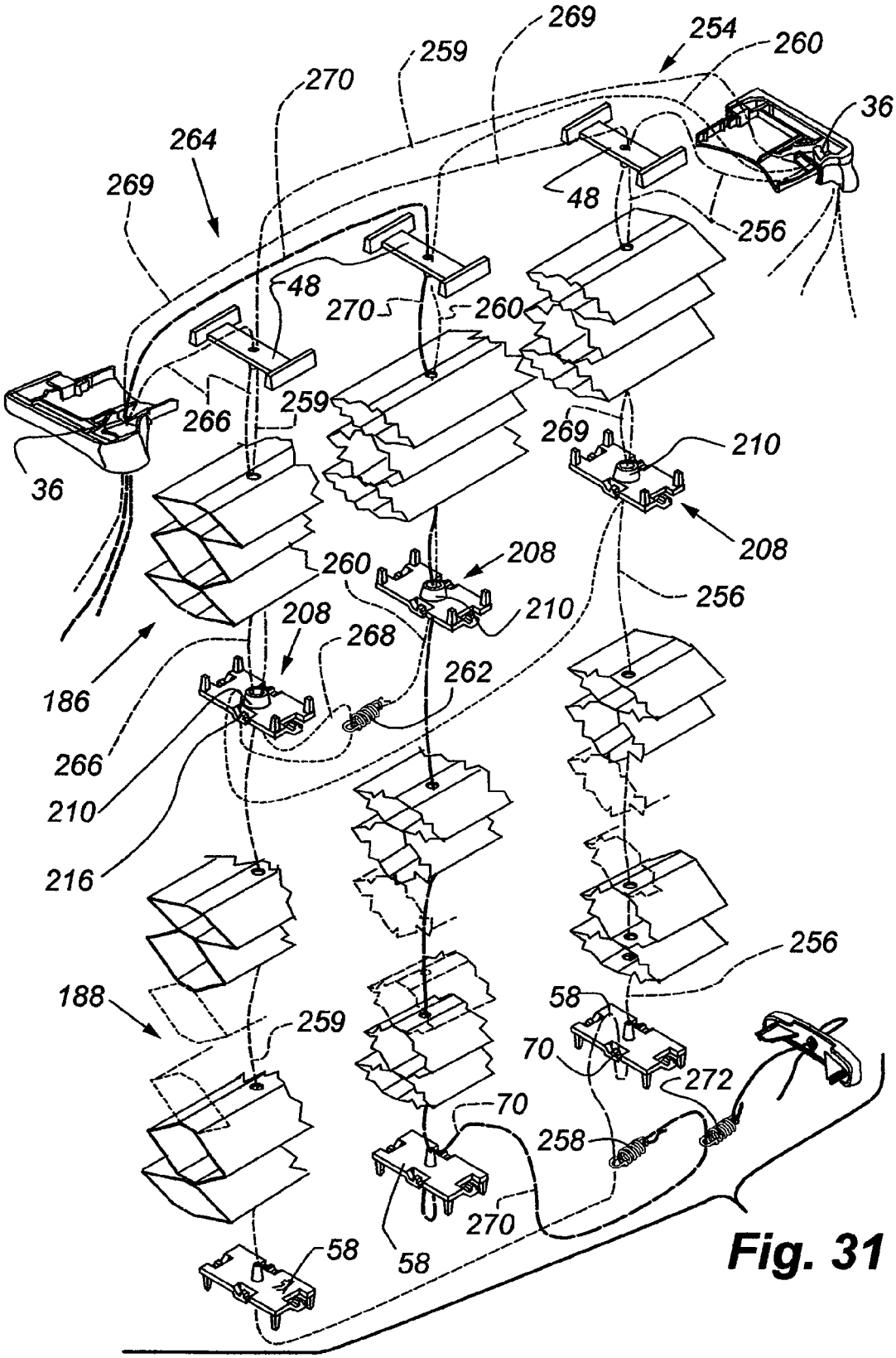
FIG. 31 is an exploded fragmentary isometric of the embodiment of FIG. 25 illustrating the cord routing.
Figure 32:
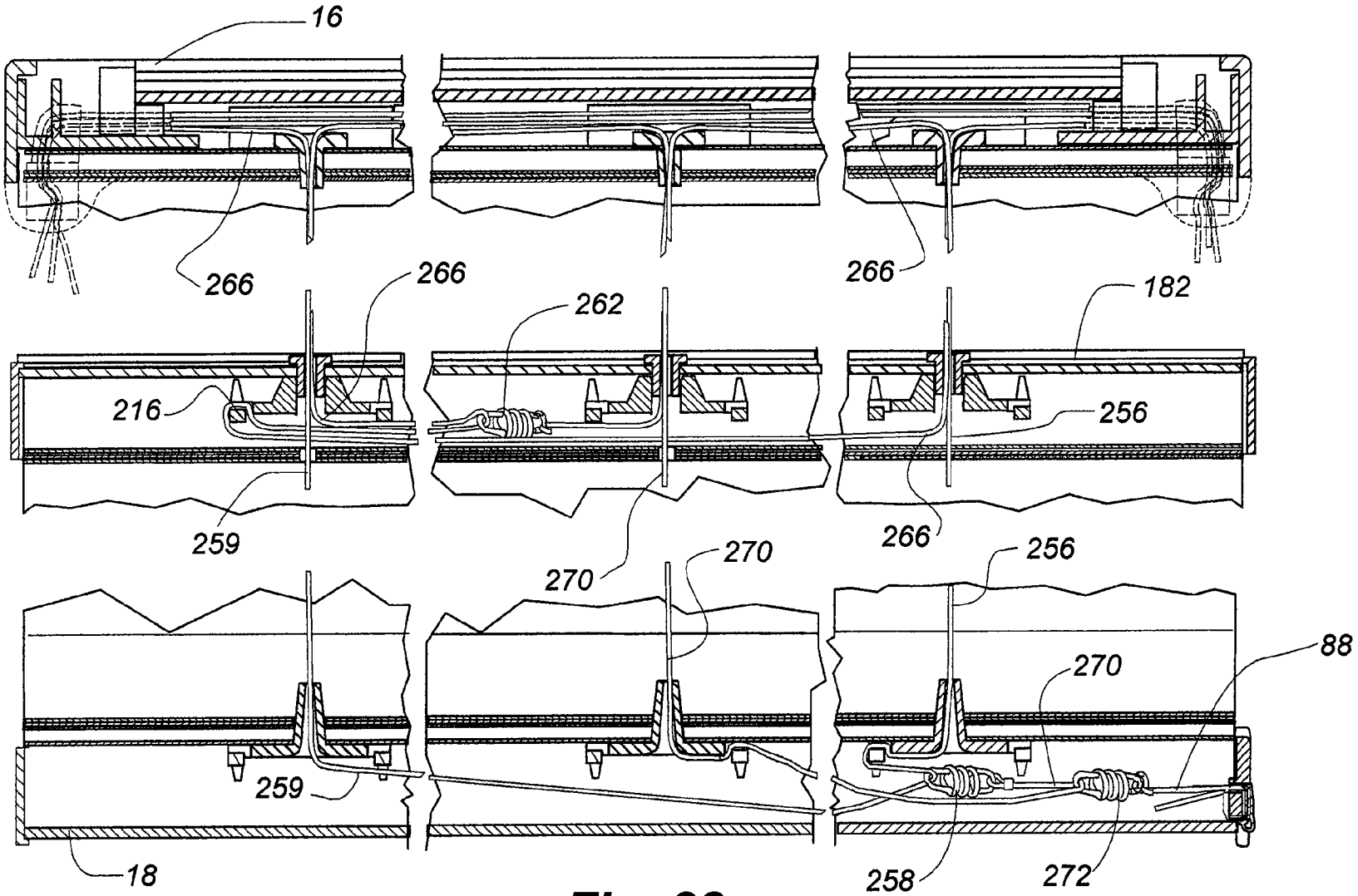
FIG. 32 is a section taken along line 32-32 of FIG. 28.

With reference to FIG. 31, it will be seen that one set of lift cords emanate from a tassel (not shown) at the right end of the head rail, which pass through a common cord lock 36 within the end cap of the head rail 16 and similarly a common set of cords emanate from a tassel (not shown) that pass through a common cord lock 36 at the left end of the head rail.

Referring first to the lift cords emanating from the tassel at the right end of the head rail, it will first be appreciated that two of those cords anchored in the tassel are the ends of a first cord loop 254 with a first run 256 of the first cord loop extending downwardly through the first-encountered slide bracket 48 and the vertically aligned cord brackets 208 and 58 found in the middle rail and the bottom rail. The first run, after passing downwardly through the neck of the first-encountered cord bracket 58 in the bottom rail 18 and subsequently upwardly across a friction finger 70 on the left edge of the cord bracket, it passes within the bottom rail and slidably through one end of a first coil spring 258 in its passage to the cord bracket 58 in the bottom rail that is furtherest left as viewed in FIG. 31. It extends upwardly through the neck of that cord bracket and vertically in a second run 259 through the large fabric segment 188 and the furthermost left cord bracket 208 of the middle rail 182 and furthermost left slide bracket 48 of the top rail 16 before returning to the tassel at the right end of the head rail. The third lift cord 260 emanating from the right end tassel of the covering extends across the head rail 16 and then downwardly through the middle slide bracket 48 and the small fabric segment 186 before extending downwardly through the neck 210 of the cord bracket 208 in the middle rail with the end of this cord segment being anchored to one end of a second coil spring 262.

The three lift cords emanating from the tassel 263 at the left end of the head rail also include two that form the ends of a second cord loop 264 having a first cord run 266 extending downwardly through the slide bracket 48 furthermost left in the head rail and through the small fabric segment 186 before extending downwardly through the neck of the furthermost left cord bracket 208 in the middle rail 182 and then slidably through the opposite end of the second coil spring 262 at the loop end 268 before returning to the left cord bracket 208 and extending past a finger 216 on the left edge thereof and then across the middle rail where it extends upwardly through the neck of the right cord bracket 208 in the middle rail in a second run 269, the small fabric segment 186 and finally the furthermost right slide bracket 48 before returning through the head rail 16 back to the left tassel.

The third cord segment 270 anchored in the left tassel extends through the head rail 16 to the middle slide bracket 48 where it passes downwardly therethrough and subsequently through the middle cord bracket 208 in the middle rail 182. The cord then extends downwardly through the large fabric segment 188 and through the neck of the middle cord bracket 58 in the bottom rail 18. It then extends upwardly across the right friction finger 70 of the middle cord bracket in the bottom rail and slidably through the end of a third coil spring 272 and subsequently is anchored to the opposite end of the first coil spring 258. The third coil spring 272 is itself anchored at its opposite ends with an anchor cord 88 to the end cap at the right end of the bottom rail.

With this routing of lift cords, the bottom rail 18 can be raised or lowered independently of the middle rail 182 by pulling downwardly or raising the tassel at the right end of the head rail and similarly, the middle rail can be raised or lowered independently of the bottom rail by pulling downwardly or raising the tassel at the left end of the head rail. Further, the middle rail and bottom rail can be leveled as described previously by forcefully sliding appropriate lift cords past friction fingers within the middle rail or bottom rail. The entire system can be tightened by adjusting the length of the anchor cords once the routing of the lift cords has been completed.

It will be appreciated from the above that additional runs of lift cords can be added depending upon the width of the covering and the number of slide brackets and cord brackets felt to be necessary to accommodate the weight. It is believed those skilled in the art could provide routing for any number of such cords consistent with the teachings of the present invention.

Although the present invention has been described with a certain degree of particularity, it is understood the disclosure has been made by way of example, and changes in detail or structure may be made without departing from the spirit of the invention as defined in the appended claims.

The invention claimed is:

1. A retractable covering for an architectural opening comprising in combination:

an elongated top rail, an elongated bottom rail, a flexible fabric interconnecting said top and bottom rails, and a lift cord having opposite ends operably interconnected for gripping by an operator of the covering and thereby forming a closed loop of said lift cord which defines an end of the loop within the bottom rail and first and second runs of the loop extending between said operably interconnected ends and said end of the loop, said runs extending at least partially along the length of said top rail and at separate locations along said flexible fabric to said bottom rail, each of said first and second runs being slidably connected to said bottom rail between releasable fixed positions at first and second locations respectively and said end of the loop being slidably connected to said bottom rail at a third location.

2. The covering of claim 1 wherein said first and second runs are frictionally biased in their connection to said bottom rail to restrict sliding relative to said bottom rail.

3. The covering of claim 2 wherein said first and second runs are connected to said bottom rail with cord brackets, each cord bracket including a friction finger in engagement with an associated run of said lift cord for resisting sliding movement of said lift cord relative to said cord bracket.

4. The covering of claim 3 wherein said cord brackets are removably connected to said bottom rail.

5. The covering of claim 3 further including first and second slide brackets mounted in said top rail through which said first and second runs slidably pass.

6. The covering of claim 1 further including a releasable cord lock for selectively permitting movement of said lift cord relative to said top rail.

7. The covering of claim 1 wherein said third location is an end of said bottom rail.

8. The covering of claim 7 wherein said end of the loop is secured to said bottom rail with a coil spring and an anchor cord, said coil spring slidably interconnecting said anchor cord with said end of the loop.

9. A retractable covering for an architectural opening comprising in combination:

an elongated top rail, an elongated bottom rail, an elongated middle rail positioned between said top and bottom rails, a flexible fabric interconnecting said middle and top rails, a first lift cord having opposite ends operably interconnected for gripping by an operator of the covering and thereby forming a first closed loop of lift cord having an end of the loop within said bottom rail and first and second runs of the loop extending said interconnected ends and said end of the loop, said runs extending at least partially along the length of said top rail and at separate locations along said flexible fabric to said bottom rail, each of said first and second runs being slidably connected to said bottom rail between releasable fixed positions at first and second locations respectively and said end of the loop being slidably connected to said bottom rail at a third location, and a second lift cord having opposite ends interconnected for gripping by an operator of the covering and thereby forming a second closed loop of lift cord which defines an end of the second cord loop in said middle rail and first and second runs of said second loop extending between its operatively connected ends and the end of the second loop, said runs extending at least partially along the length of said top rail and at separate locations to said middle rail, each of said first and second runs of said second cord loop being slidably connected to said middle rail between releasable fixed positions at first and second locations respectively in said middle rail.

10. The covering of claim 9 further including a second flexible fabric interconnecting said top rail and middle rail.

* * * * *